US006003563A

United States Patent [19]

Uchida et al.

[11] Patent Number: 6,003,563

[45] Date of Patent: Dec. 21, 1999

[54] THREE-DIMENSIONAL WEAVING MACHINE

[75] Inventors: Hiroshi Uchida, Oumihachiman; Takumi Yamamoto, Uji; Hiroki Takashima, Kusatsu; Hirao Otoshima, Shiga-gun; Tetsuya Yamamoto, Nisshin; Shigeru Nishiyama, Toyoake; Masahiro Shinya, Nagoya, all of Japan

[73] Assignees: Mitsubishi Heavy Industries, Ltd., Tokyo; Murata Kikai Kabushiki Kaisha, Kyoto, both of Japan

[21] Appl. No.: 09/082,194

[22] Filed: May 21, 1998

[30] Foreign Application Priority Data

May 22, 1997 [JP] Japan ..... 9-150128
May 22, 1997 [JP] Japan ..... 9-150130

[51] Int. Cl.[6] ..... D03D 41/00

[52] U.S. Cl. ..... 139/11; 139/DIG. 1

[58] Field of Search ..... 139/11, DIG. 1

[56] References Cited

FOREIGN PATENT DOCUMENTS

| | | |
|---|---|---|
| 4-11043 | 1/1992 | Japan . |
| 5-106140 | 4/1993 | Japan . |
| WO 94 16131 | 7/1994 | Japan . |
| 9-111591 | 4/1997 | Japan . |
| WO 95 12015 | 5/1995 | WIPO . |
| WO 96 06213 | 2/1996 | WIPO . |

OTHER PUBLICATIONS

Patent Abstracts of Japan, vol. 017, No. 458, Aug. 20, 1993.
Patent Abstracts of Japan, vol. 016, No. 156, Apr. 16, 1992.
European Search Report; Annex to European Search Report.

*Primary Examiner*—John J. Calvert
*Assistant Examiner*—Robert H Muromoto, Jr.
*Attorney, Agent, or Firm*—Armstrong, Westerman, Hattori, McLeland and Naughton

[57] ABSTRACT

A three-dimensional weaving machine that enables biased yarn guide blocks to be reduced in size and their movement to be simplified and that reliably feeds biased yarns is described. A three-dimensional mechanism contains 2N guide blocks (13), each including a biased yarn through-hole (15) extending along the length direction. A guide block receiving and supporting device (18) forms guide block arrangement spaces (S1), (S2), and (S3) in a bottom stage, a middle stage, and a top stage wherein N of the 2N guide blocks can be arranged in each stage parallel with, and adjacent to, one another. A guide block moving device (22) is provided for moving the guide blocks in each stage in opposite directions along the respective stages, and a shifting device (44) operates for simultaneously shifting two adjacent sets of guide blocks movably arranged in the respective guide block arrangement spaces, each by one stage.

10 Claims, 32 Drawing Sheets

THREE-DIMENSIONAL WEAVING MACHINE

FIELD OF THE INVENTION

The present invention relates to a three-dimensional weaving machine for weaving a three-dimensional multi-axis fiber structure (a three-dimensional multi-axis woven fabric), and in particular, to a three-dimensional weaving machine including an improved biased yarn feeding apparatus as an integral part.

BACKGROUND OF THE INVENTION

Three-dimensional weaving machines for weaving a five-axis three-dimensional woven fabric consisting of warps, wefts, biased yarns, and vertical yarns have been proposed in Japanese Patent Application Laid Open (Tokkai Hei) No. 4-11043 and Japanese Patent Application Laid Open (Tokkai Hei) No. 5-106140. The three-dimensional weaving machines described in these publications guide warps and biased yarns to a cloth fell in the weaving machine, form the warps into a plurality of warp-layers while forming the biased yarns into a set of two biased yarn-layers, and locate the biased yarn-layers between the warp-layers. The biased yarns in one of the two layers are tilted at a specified angle relative to the warps, while the biased yarns in the other layer are tilted at the same angle in the opposite direction. Furthermore, wefts are inserted between the warp-layers and between the biased yarn-layers, and vertical yarns are inserted between the warps and between the biased yarns in the respective layers in the thickness direction of the layers. Therefore, five-axis three-dimensional woven fabrics are woven, and by the vertical yarns, the warps, wefts, and biased yarns are connected and structured.

In a three-dimensional weaving machine for weaving five-axis three-dimensional woven fabrics consisting of warps X, wefts Y, biased yarns B1, B2, and vertical yarns Z, a single continuous yarn is inserted through a large number of yarn guiding members, so it is very difficult to automate the insertion of the biased yarns that are inserted so as to be tilted like diagonal braces at a specified angle relative to the longitudinal and transverse directions in which fibrous yarns are arranged. Therefore, there has been a need for the development of a reasonable mechanism for realizing this automation.

Biased yarn feeding mechanisms for a three-dimensional weaving machine for weaving five-axis three-dimensional woven fabrics such as those described in Japanese Patent Application Laid Open No. 4-11043 and Japanese Patent Application Laid Open No. 5-106140 are already known. The biased yarn feeding mechanisms described in these publications feed biased yarns by circularly moving them along an annular track. In such a mechanism for circularly moving the biased yarns along the annular track, however, the feeding side of the biased yarns must also be moved circularly to prevent the yarns from becoming intertwined, thereby preventing long biased yarns from being continuously woven.

Therefore, the present invention provides a three-dimensional weaving machine, such as that described above, that includes a compact biased yarn feeding apparatus that enables long yarns to be continuously woven, in particular, a three-dimensional weaving machine that allows biased yarn guide blocks used to feed biased yarns to be reduced in size, which prevents the movement of the guide blocks from being complicated in order to enable biased yarns to be fed accurately and reliably, and that uses a compact apparatus to weave wide (e.g., approximately 3 m) three-dimensional woven fabrics reliably.

SUMMARY OF THE INVENTION

To achieve this object, the present invention provides a three-dimensional weaving machine comprising 2N guide blocks including a biased yarn insertion hole; a guide block receiving and support means that forms guide block arrangement spaces in a top stage, a middle stage, and a bottom stage wherein N guide blocks can be arranged in each stage parallel and adjacent to one another; a guide block moving means for moving adjacent stages of the guide blocks along the respective stages in the opposite directions; and a shifting means for shifting together the guide blocks movably arranged in the guide block arrangement spaces in two adjacent stages in such a way that each stage is shifted by one stage.

Furthermore, according to the present invention, the guide block moving means comprises a transverse moving means for pressing the guide blocks in each stage sideways to feed them in the transverse direction; and a raising means for raising a guide block that protrudes sideward from the space, and the shifting means comprises a lowering means for shifting together the guide blocks movably arranged in the middle and top stages in such a way that each stage is shifted downward by one stage.

Furthermore, according to the present invention, the guide block moving means comprises a transverse moving means for pressing the guide blocks in each stage sideways to feed them in the transverse direction; and a lowering means for lowering a guide block that protrudes sideward from the space, and the shifting means comprises a lifting means for shifting together the guide blocks movably arranged in the middle and bottom stages in such a way that each stage is shifted upward by one stage.

Furthermore, according to the present invention, the shifting means includes a sandwiching means for sandwiching two stages of guide blocks together in the vertical direction and shifting each stage by one stage.

BRIEF DESCRIPTION OF THE DRAWINGS

FIG. 4 shows a basic configuration of a biased yarn orientation apparatus according to the present invention and a specific embodiment of a biased yarn guide block that guides biased yarns in which

FIG. 5 are right-side views of the biased yarn orientation apparatus in FIG. 4A in which

FIG. 7 shows the relationship between the guide blocks and a guide block horizontal-moving means in which

FIG. 17 shows FIG. 16 as seen from the front in which

FIG. 33 shows the structure of a chain section of a chain conveyor wherein

DETAILED DESCRIPTION OF THE PREFERRED EMBODIMENTS

A biased yarn feeding apparatus for a three-dimensional mechanism according to the present invention is described below in detail with reference to specific embodiments.

Figure 1:
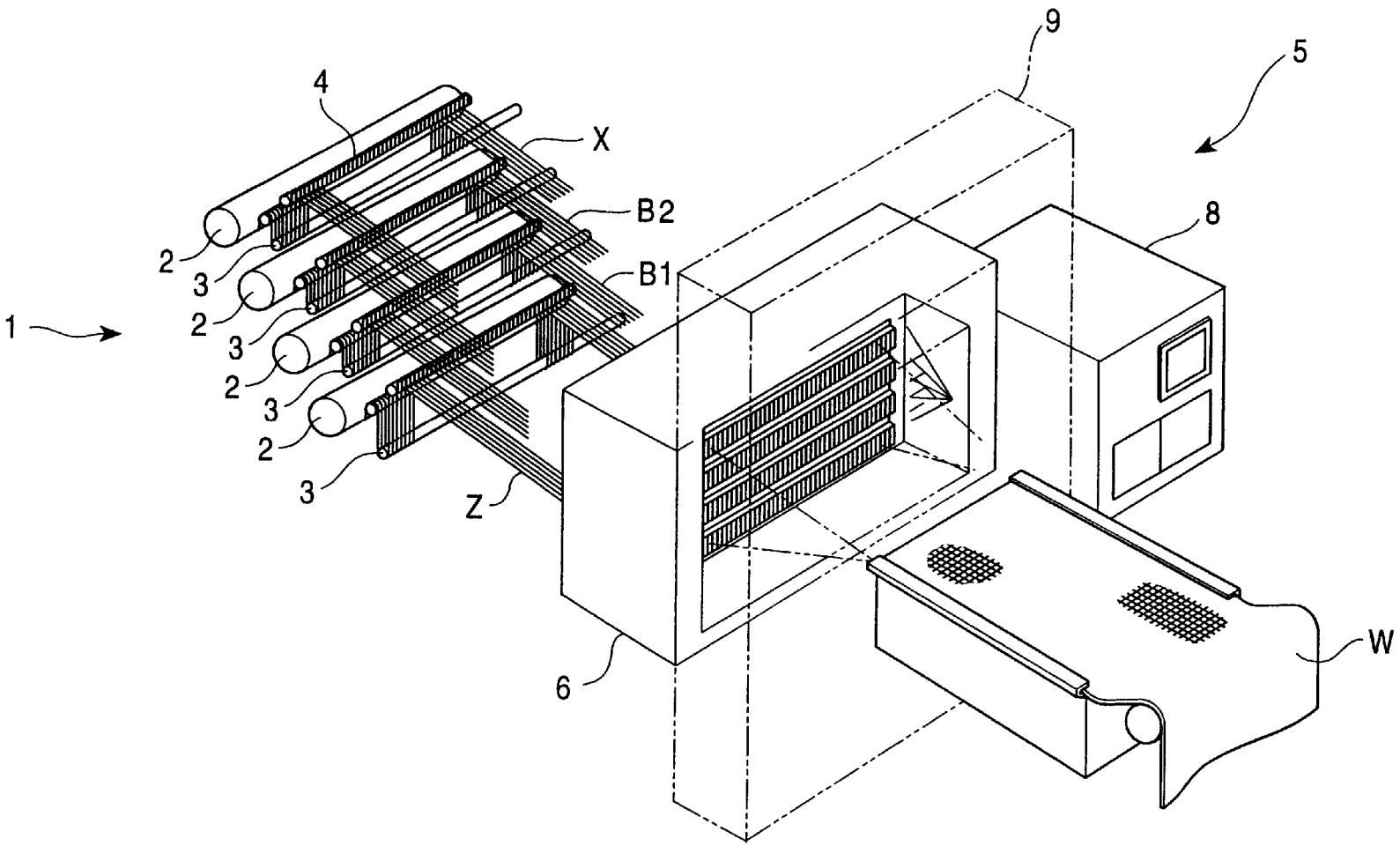
FIG. 1 is a schematic perspective view of a three-dimensional weaving machine to which a biased yarn feeding apparatus according to the present invention is applied.
Figure 2:
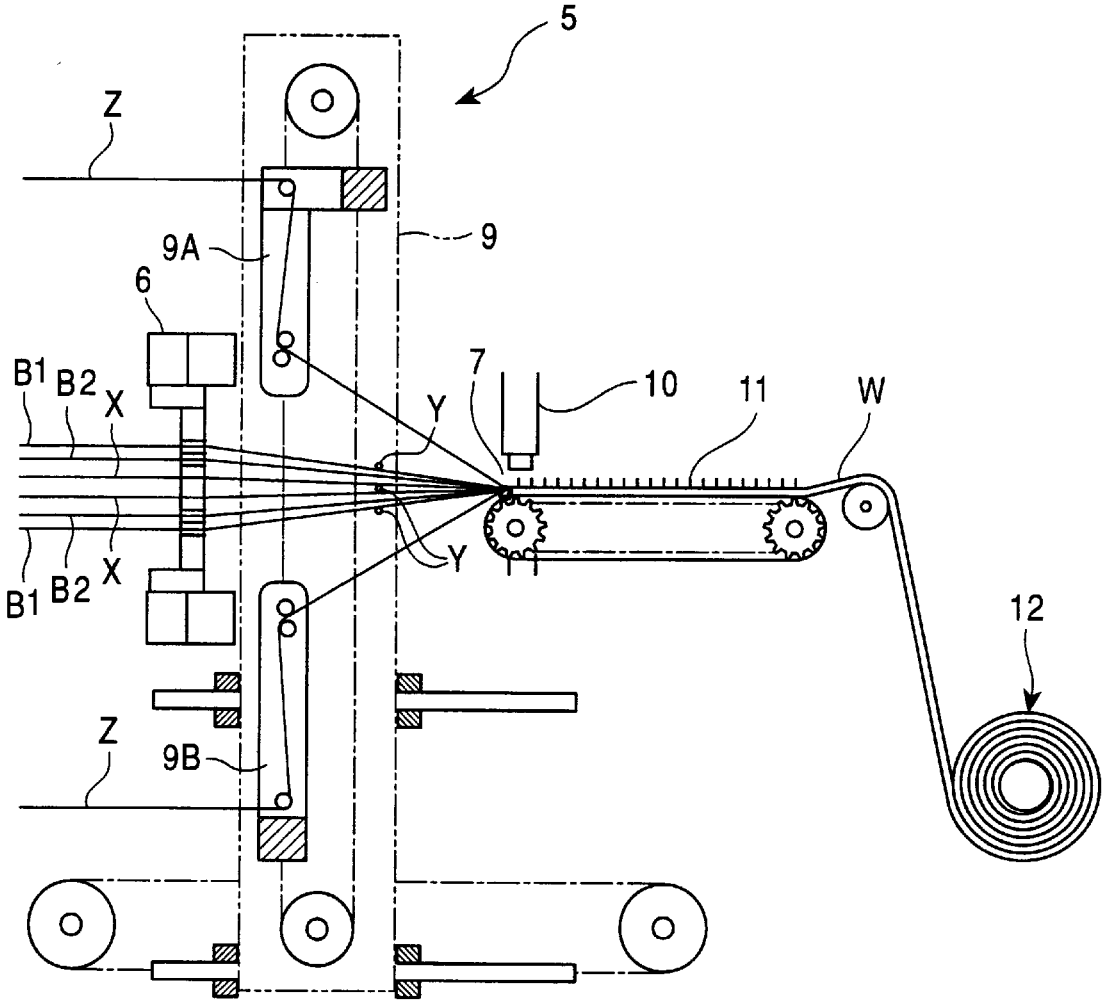
FIG. 2 is a side view schematically showing the entire three-dimensional weaving machine.
Figure 3:
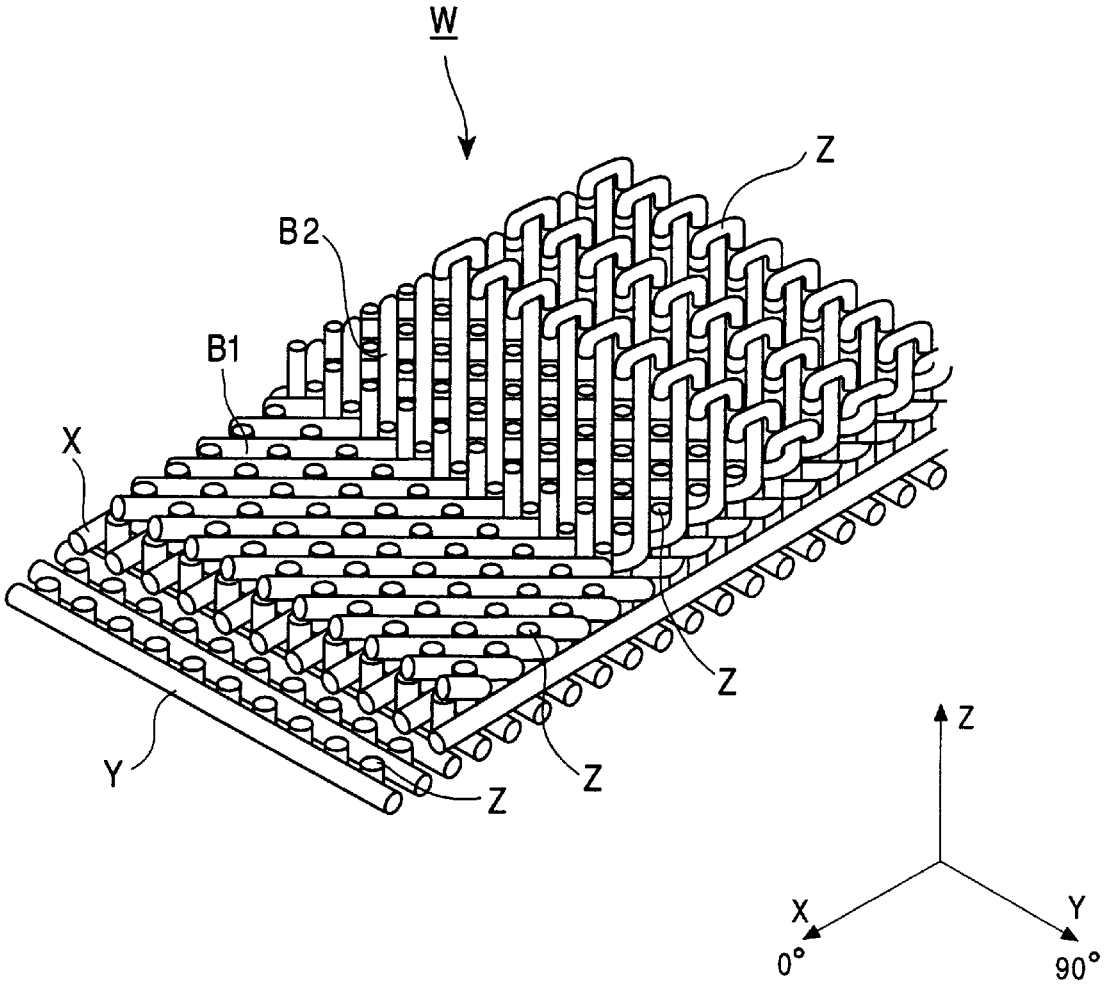
FIG. 3 is a schematic perspective view showing a specific structure of a three-dimensional woven fabric produced by the three-dimensional weaving machine.

FIG. 1 is a schematic perspective view showing a specific embodiment of a three-dimensional mechanism to which a biased yarn feeding apparatus is applied according to the present invention. FIG. 2 is a side view schematically showing the mechanism shown in FIG. 1 weaving machine. FIG. 3 is a schematic perspective view showing a specific configuration of a three-dimensional woven fabric that is woven by this three-dimensional weaving machine.

FIGS. 1 and 2 show a specific example of a three-dimensional weaving machine, for weaving a five-axis three-dimensional woven fabric W, that has a yarn feeding apparatus 1 composed of a plurality of beams 2. Warps X, biased yarns B1, B2 and vertical yarns Z are wound around each beam 2 in the yarn feeding apparatus 1. The warps X, biased yarns B1, B2 and vertical yarns Z are fed from each beam 2 and guided to a frame 5 through a dancer roller 3 and a split guide 4.

Within the frame 5, the warps X and the biased yarns B1, B2 pass through a biased yarn orientation apparatus 6 and are guided to a cloth fell section 7, where a plurality of warp-layers are forced of the warps X while a set of two biased yarn-layers are formed of the biased yarns B1, B2 and are then located between the warp-layers, as shown in FIG. 2. The biased yarn orientation apparatus 6 operates the biased yarns B1, B2 in such a manner that the biased yarns B1 in one of the layers are inserted so as to be tilted at a specified angle (e.g., +45°) relative to the warps X whereas the biased yarns B2 in the other layer are inserted so as to be tilted at the same angle in the opposite direction (e.g., −45°) relative to the warps X.

Furthermore, a weft insertion apparatus 8 operates the wefts Y so as to insert them between the warp-layers and outside the set of two biased yarn-layers.

Furthermore, a vertical yarn insertion apparatus 9 inserts the vertical yarns Z. The vertical yarn insertion apparatus 9 has an upper vertical yarn insertion member 9A and a lower vertical yarn insertion member 9B wherein between the biased yarn orientation apparatus 6 and the cloth fell section 7, the upper vertical yarn insertion member 9A inserts the vertical yarns Z from above the warps X and the biased yarns B1, B2, while the lower vertical yarn insertion member 9B inserts the vertical yarns Z from below the warps X and the biased yarns B1, B2.

A press means 10 is disposed on the downstream side of the cloth fell section 7, and the three-dimensional woven fabric W passes through a woven fabric shape retention section 11 for stabilizing the shape of a woven fabric and is wound around a woven fabric winding section 12.

Figure 4A:
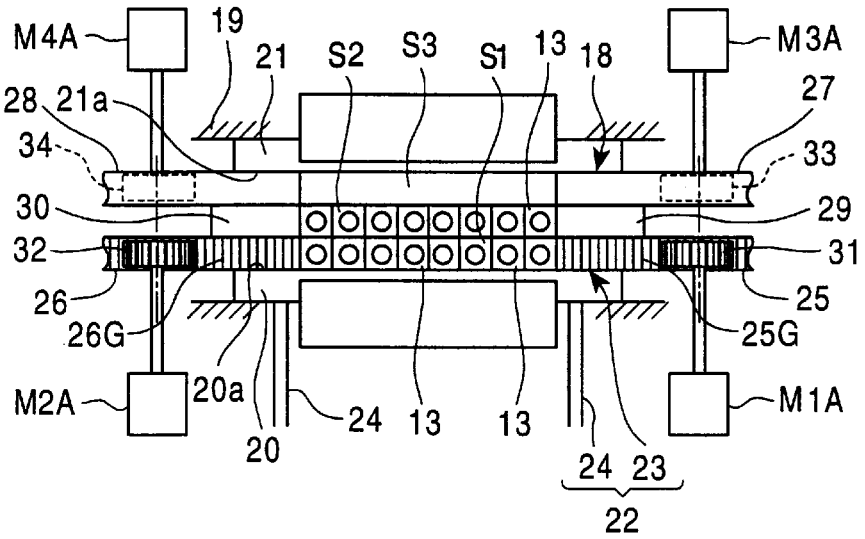
FIG. 4A is a schematic front view showing a basic configuration of the biased yarn orientation apparatus.
Figure 4B:
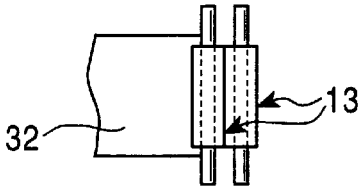
FIG. 4B is a schematic top view showing the relationship between guide blocks and a slider member.
Figure 4C:
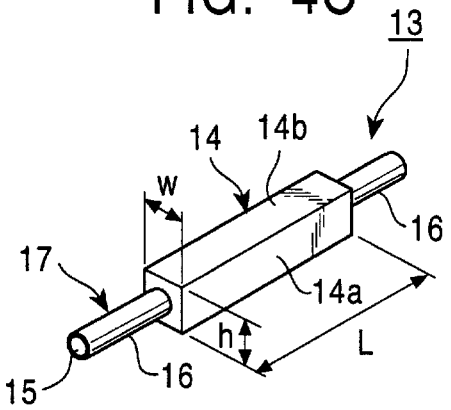
FIG. 4C is a schematic perspective view showing a specific embodiment of the biased yarn guide block.
Figure 5A:
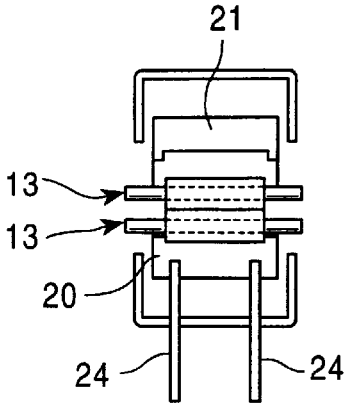
FIG. 5A is a schematic side view of the state in which the guide blocks are arranged in guide block arrangement spaces S1 and S2 in a bottom and a middle stages.
Figure 5B:
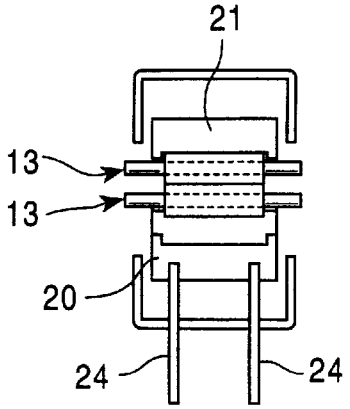
FIG. 5B is a schematic side view of the state in which the guide blocks are arranged in the guide block arrangement space S2 in the middle stage and in a guide block arrangement space S3 in a top stage.
Figure 6:
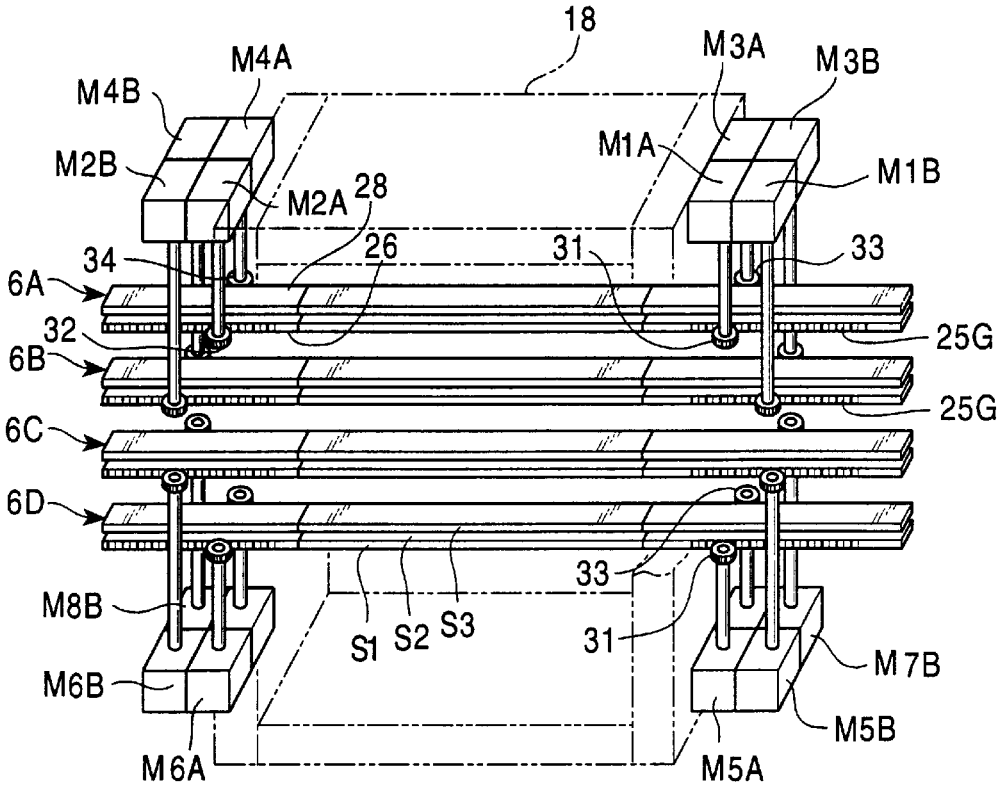
FIG. 6 is a schematic perspective view showing a specific embodiment of the biased yarn orientation apparatus shown in FIG. 4A, which is configured in four stages.
Figure 7A:
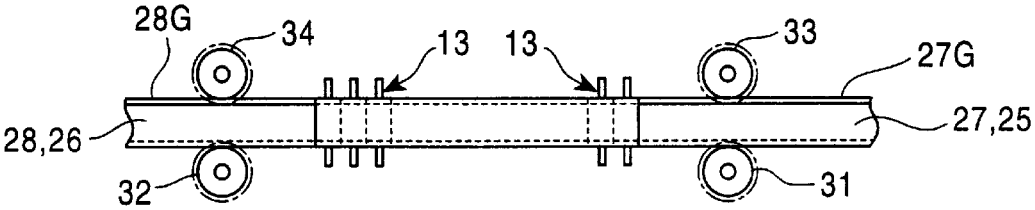
FIG. 7A is a schematic top view and FIG. 7B is a schematic front view.
Figure 7B:
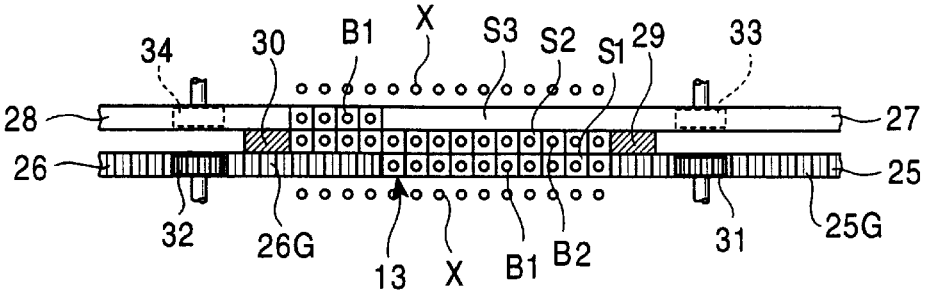

The biased yarn orientation apparatus 6 for feeding the biased yarns B1, B2, which is an integral part of the three-dimensional weaving machine according to the present invention, is described below in detail. FIGS. 4A to 4C show a basic configuration of the biased yarn orientation apparatus 6 according to the present invention and a specific embodiment of a biased yarn guide block that guides the biased yarns.

First, a specific embodiment of a biased yarn guide block 13 that is the most important component of the present invention is described with reference to FIG. 4C. The biased yarn guide block 13 includes a block base 14 of a rectangular cross section and having a width w, a height h, and a length L, and a pipe member 17 that penetrates the block base 14 lengthwise to form a biased yarn insertion hole 15 that allows a biased yarn B to pass through along the length direction and further to form extension parts 16, 16 extending externally from the respective length-wise ends of the block base 14.

The biased yarn guide blocks 13 can be arranged in a matrix in such a manner that adjacent guide blocks abut one another on both sides 14*a* and 14*a* and top and bottom surfaces 14*b* and 14*b* of the block base 14. The width w of the block base 14 of the biased yarn guide block 13 corresponds to the weaving feeding pitch of the three-dimensional weaving machine. For a weaving feeding pitch of 4 mm, the width w is designed to be 4 mm. The height h of the block base 14 is designed to correspond to guide block arrangement spaces in a bottom stage, a middle stage and a top stage, which are described below, and is about 5 mm in a specific embodiment.

The biased yarn orientation apparatus 6 includes a guide block receiving and supporting means 18. The guide block receiving and supporting means 18 includes a lower guide rail member 20 and an upper guide rail member 21 that are mounted on a machine frame 19. The top surface 20*a* of the lower guide rail member 20 and the bottom surface 21*a* of the upper guide rail member 21 are mutually opposed in parallel. When the biased yarn guide blocks 13 are placed on one another in the height direction, the upper and lower guide rail members 20, 21 form guide block arrangement spaces S1, S2, and S3 in a bottom stage, a middle stage, and a top stage.

The biased yarn orientation apparatus 6 includes a guide block moving means 22 for moving the guide blocks 13 through the guide block arrangement spaces S1, S2, and S3 in a predetermined regular manner, i.e., in such a way that the adjacent stages are moved along the respective stages in the opposite directions. The guide block moving means 22 includes a transverse moving means 23 for pressing the guide blocks 13 in each stage sideways to move them in the transverse direction, and a raising means 24 for raising a guide block 13 that protrudes sideward from the space.

The transverse moving means 23 of the guide block moving means 22 includes a first lower slider 25 that intermittently presses the guide blocks 13 arranged in the guide block arrangement space S1 in the bottom stage from right to left in FIG. 4A at each pitch, a second lower slider 26 that intermittently presses the guide blocks 13 from left to right at each pitch, a first upper slider 27 that intermittently presses the guide blocks 13 arranged in the guide block arrangement space S3 in the top stage from right to left at each pitch, a second upper slider 28 that intermittently presses the guide blocks 13 from left to right at each pitch, a first middle pusher 29 that intermittently presses the guide blocks 13 arranged in the guide block arrangement space S2 in the middle stage from right to left at each pitch, and a second middle pusher 30 that intermittently presses the guide blocks 13 from left to right at each pitch.

According to a specific embodiment, as shown in FIGS. 4A, 6, 7A and 7B, the transverse moving means 23 of the guide block moving means 22 has on its front surface in FIG. 4A rack gears 25G and 26G for the sliders 25 and 26 and has on its rear surface rack gears 27G and 28G for the sliders 27 and 28. Pinion gears 31, 32, 33 and 34 rotated by motors M1A, M2A, M3A and M4A, respectively, engage the rack gears 25G, 26G, 27G and 28G, respectively.

Figure 8:
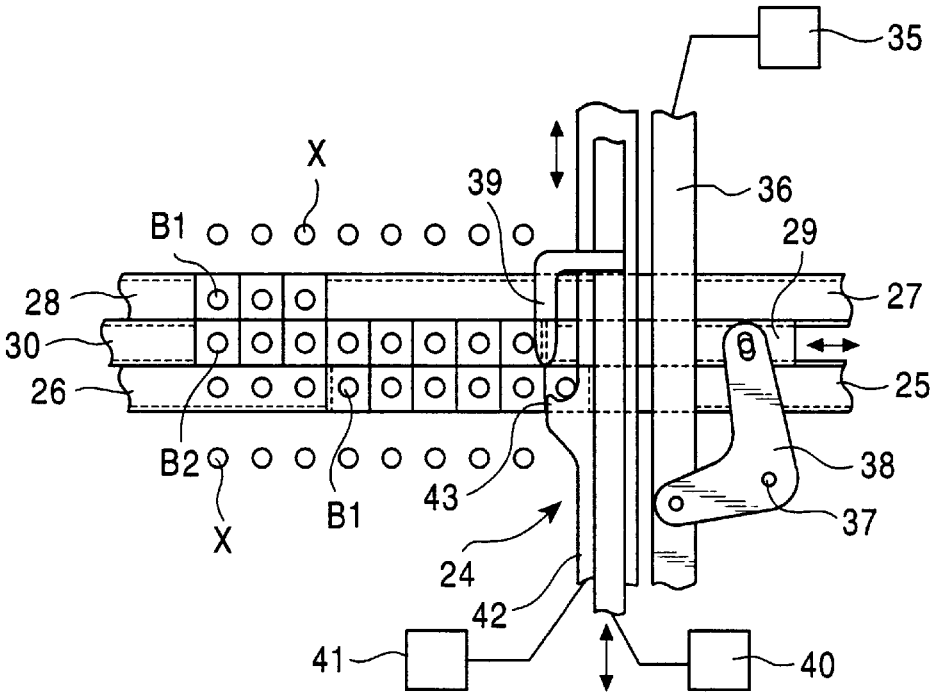
FIG. 8 is a schematic front view showing a specific embodiment of a guide block raising means.
Figure 9:
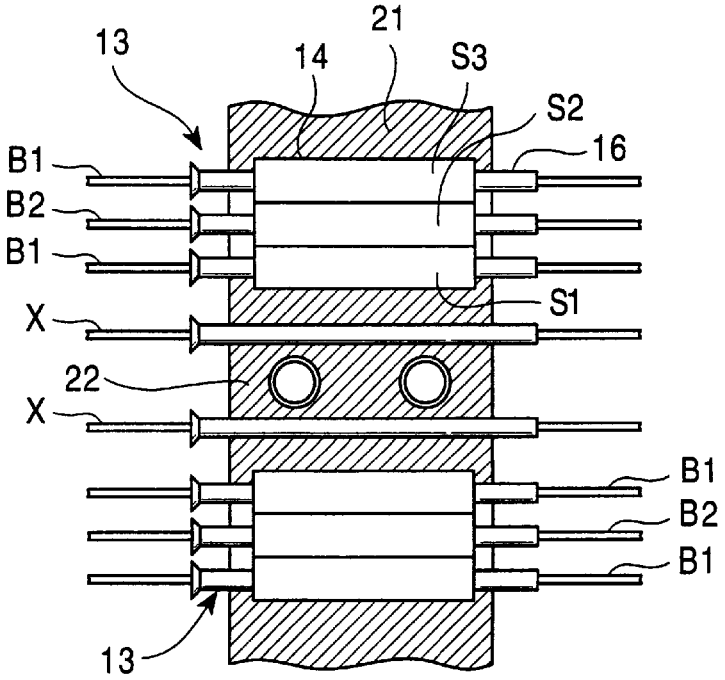
FIG. 9 is a schematic side sectional view showing the relationship between the orientations of biased yarns and warps.

A first pusher 29 in the middle stage and a second pusher 30 in the middle stage are configured to move 4 mm forward and backward in the transverse direction via a vertical driving member 36 connected to a cylinder apparatus 35 and a pivoting connecting member 38 that can pivot around a pivot point 37, as shown in FIG. 8. A separator member 39 that advances between the pipe members 17 of the adjacent guide blocks 13 at its transverse end abuts the guide blocks 13 in the guide block arrangement space S2 in the middle stage. The separator member 39 can be moved in the vertical direction by the cylinder apparatus 40 and serves to check the returning of the guide blocks 13.

When the transverse moving means 23 presses transversely the guide blocks 13 arranged in the guide block arrangement space S1 or S2 in the bottom or middle stage, the raising means 24 of the guide block moving means 22 raises the guide block 13 that protrudes sideward from the space up to the guide block arrangement space S2 or S3 in the middle or top stage, respectively.

As shown in FIG. 8, the raising means 24 includes a vertical driving member 42 that can be moved in the vertical direction by the cylinder apparatus 41. The vertical driving means 42 has an engaging portion 43 that engages the pipe member 17 of the guide block 13 to receive and support the guide block 13.

The guide block moving means 22 uses the transverse moving means 24 and the raising means 25 to sequentially move the guide blocks 13 from the guide block arrangement space S1 in the bottom stage to the guide block arrangement space S2 in the middle stage, while sequentially moving the guide blocks 13 from the guide block arrangement space S2 in the middle stage to the guide block arrangement space S3 in the top stage. The guide block moving means 22 moves the guide blocks in a snake-like motion, and when the guide block arrangement spaces S3 and S2 in the top and middle stages become full of the guide blocks 13, a shifting means 44, which is described below, shifts the stages simultaneously.

According to the present invention, the guide block moving means 22 is not limited to the above embodiment, but the guide blocks 13 in the guide block arrangement space S3 in the top stage may be sequentially moved to the guide block arrangement space S2 in the middle stage, while the guide blocks 13 in the guide block arrangement space S2 in the middle stage may be sequentially moved to the guide block arrangement space S1 in the bottom stage. Then, when the guide block arrangement spaces S2 and S1 in the middle and bottom stages are filled by the guide blocks 13, the shifting means 44, which is described below, shifts the sets of guide blocks simultaneously. In this case, the raising means 25 of the guide block moving means 22 is changed to a lowering means and the shifting means is changed to a simultaneous raising means.

A specific embodiment of the shifting means 44 for shifting together the sets of guide blocks movably arranged in the guide block arrangement spaces in adjacent stages in such a way that each set is shifted by one stage is explained with reference to FIGS. 10 and 11.

As described above, the shifting means 44 is configured as either a lowering means for shifting together the guide blocks movably arranged in the middle and top stages in such a way that each set is shifted downwardly by one stage, or a raising means for shifting together the guide blocks movably arranged in the middle and bottom stages in such a way that each set is shifted upwardly by one stage.

Figure 10:
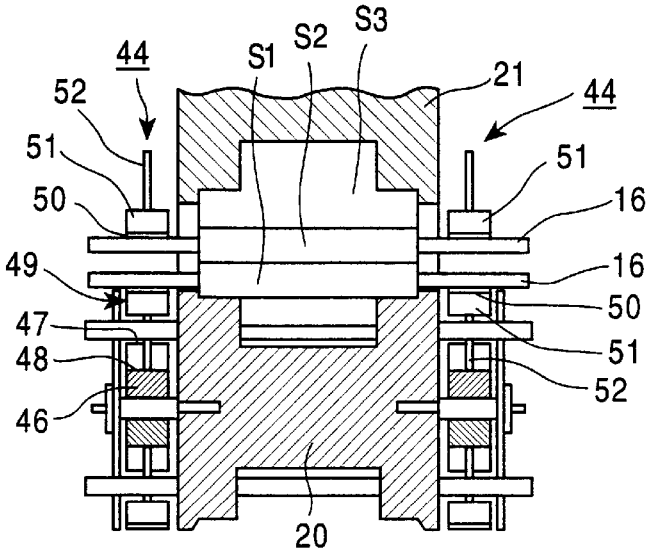
FIG. 10 is a schematic side sectional view showing a specific embodiment of a guide block shifting means.
Figure 11:
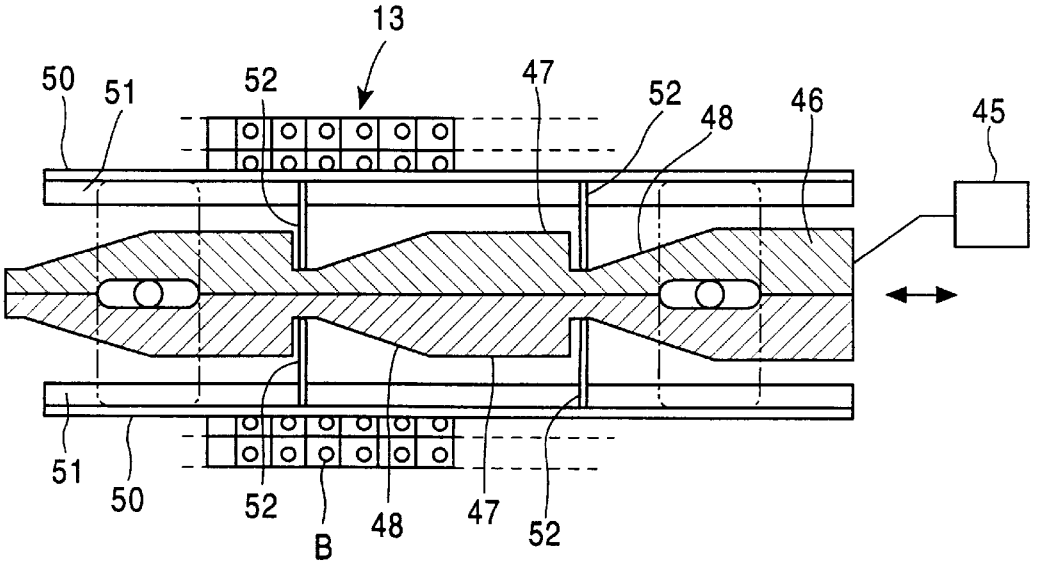
FIG. 11 is a schematic front view as seen from the left of FIG. 10 showing a specific embodiment of the guide block shifting means.

According to the embodiment shown in FIGS. 10 and 11, the shifting means 44 includes a cam member 46 that can be moved back and forth in the lateral direction by various means, including a cylinder apparatus 45. The cam member 46 comprises a horizontal cam surface 47 and an inclined cam surface 48 continuing from the horizontal cam surface 47. The shifting means 44 includes a sandwiching member 49 for sandwiching two stages of guide blocks together in the vertical direction and shifting each stage by one stage.

When, for example, the guide block arrangement space S3 in the top stage and the guide block arrangement space S2 in the middle stage are filled by the guide blocks 13, the sandwiching means 49 sandwiches the two stages of guide blocks 13 together in the vertical direction. The sandwiching means 49 is composed of a switching bar member 51 including an urethane resin layer 50 on a surface that abuts the pipe member 17 of the each guide block 13, and a plurality of rod members 52 that are attached to the sandwiching bar member 51 and the tip of the rod members 52 abuts the cam surface of the cam member 46.

In the biased yarn orientation apparatus 6, the horizontal moving means 23 of the guide block moving means 22 moves the guide blocks 13 in adjacent stages 4 mm per pitch along the respective stages in the opposite directions to enable the biased yarns B1 to be inserted so as to be biased at an angle of +45° relative to the warps X while enabling the biased yarns B2 to be inserted so as to be biased at an angle of −45° relative to the warps X. After shifting by the shifting means 44, the bias direction is inverted.

Although the unitary configuration of the biased yarn orientation apparatus 6 has been illustrated in order to explain its basic configuration, a plurality of sets of two biased yarn B1, B2 layers are commonly provided instead of simply forming a single set of two biased yarn-layers.

An embodiment of the biased yarn orientation apparatus 6 is shown that allows four sets of two biased yarn layers to be formed. According to the embodiment shown in FIG. 6, the biased yarn orientation apparatuses 6 described above are combined together as apparatuses 6A, 6B, 6C and 6D. The horizontal moving means 23 of the guide block moving means 22 is provided in each of the apparatuses 6A, 6B, 6C and 6D in the respective stages. According to this specific embodiment, the rack gears 25G and 26G are provided on the front side of the sliders 25 and 26, respectively, and the rack gears 27G and 28G are provided on the rear surface of the sliders 27 and 28, respectively.

The pinion gears 31, 32, 33 and 34 rotated by the motors M1A, M2A, M3A and M4A, respectively, engage the rack gears 25G, 26G, 27G and 28G of the apparatus 6A, respectively. The pinion gears 31, 32, 33 and 34 rotated by motors M1B, M2B, M3B and M4B, respectively, engage the rack gears 25G, 26G, 27G and 28G of the apparatus 6B, respectively. The pinion gears 31, 32, 33 and 34 rotated by motors M1C, M2C, M3C and M4C, respectively, engage the rack gears 25G, 26G, 27G and 28G of the apparatus 6C, respectively. The pinion gears 31, 32, 33 and 34 rotated by motors M1D, M2D, M3D and M4D, respectively, engage the rack gears 25G, 26G, 27G and 28G of the apparatus 6D, respectively. By forming the drive source of each horizontal moving means 23 of an individual motor, the horizontal movement timing of the guide blocks in each stage can be individually controlled. If the biased yarns are fed using a three-stage feeding apparatus, −45°-biased yarns are arranged over and under +45°-biased yarns in a set of two biased yarn-layers. By moving the feeding phase of the biased yarns in each stage, the boundary between the −45°-biased yarns located over and under the +45°-biased yarns can be moved for each stage to form woven fabrics that are uniform in the thickness direction.

Figure 12:
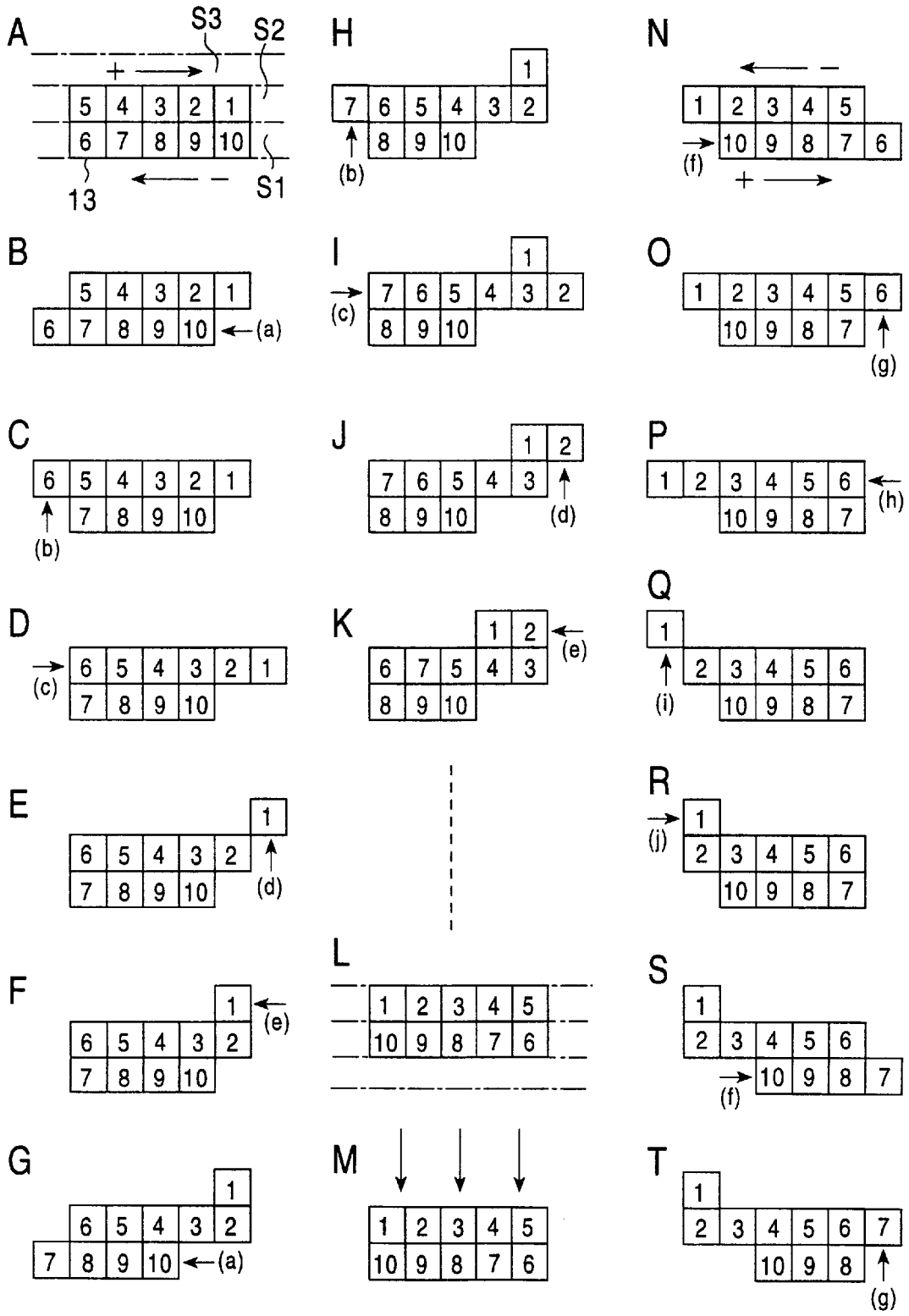
FIGS. 12A to 12T are schematic front views showing the guide blocks as simplified blocks in order to describe the movement aspect of the guide blocks.

The movement of the biased yarn guide block 13 in the biased yarn orientation apparatus 6 is described with reference to FIG. 12. In FIG. 12, the guide block moving means 22 is composed of the horizontal moving means 23 for pressing the guide blocks 13 in each stage sideways to move them in the horizontal direction, and the raising means 24 for raising the guide block that protrudes sideward from the space, and the shifting means 44 is composed of a lowering means for shifting together the guide blocks movably arranged in the middle and top stages in such a way that each stage is shifted downward by one step. For simplification, ten biased yarn guide blocks 13 are shown in FIG. 12, but the number of biased yarn guide blocks 13 is actually 2N wherein N is 750 if a three-dimensional woven fabric of 3 m weaving width is woven at a pitch of 4 mm.

In FIG. 12A, the guide block arrangement space S2 in the middle stage is full of the guide blocks 13 Nos. 1 to 5 from right to left, and the guide block arrangement space S1 in the bottom stage is full of the guide blocks 13 Nos. 6 to 10 from left to right.

Under this condition, the motor M1A of the horizontal moving means 23 presses the guide blocks arranged in the guide block arrangement space S1 in the bottom stage, for one pitch in the direction shown by arrow (a). The guide block No. 6 located at the left end of the guide block arrangement space S1 in the bottom stage protrudes leftward from the space. The protruding guide block No. 6 is raised by the raising meansup to the guide block arrangement space S2 in the middle stage along the direction shown by arrow (b).

The raised guide block No. 6 is pressed by the second pusher 30 in the middle stage for one pitch in the direction shown by arrow (c). This pressing operation causes the guide block No. 1 located at the right end of the guide block arrangement space S2 in the middle stage to protrude rightward from the space. The protruding guide block No. 1 is raised by the raising means up to the guide block arrangement space S3 in the top stage along the direction shown by arrow (d).

The raised guide block No. 1 is pressed by the motor M3A of the horizontal moving means 23 for one pitch in the direction indicated by arrow (e). The moving operation from (a) through (e) corresponds to one cycle in the previous half (prior to shifting) of the process executed by the guide block moving means 22, and repeating this cycle five times allows the guide blocks Nos. 1 to 5 to be filled in the guide block arrangement space S3 in the top stage from left to right while allowing the guide blocks Nos. 6 to 10 to be filled in the guide block arrangement space S2 in the middle stage from right to left, as shown in FIG. 12L.

The shifting means 44 is then operated to shift the guide blocks Nos. 1 to 5 arranged in the guide block arrangement space S3 in the top stage to the guide block arrangement space S2 in the middle stage while shifting the guide blocks Nos. 6 to 10 arranged in the guide block arrangement space S2 in the middle stage to the guide block arrangement space S1 in the bottom stage, without changing the order of the guide blocks. FIGS. 12A and 12L show the guide block arrangement spaces S1 and S2 in the bottom and middle stages, respectively, as being filled by the guide blocks, but the order of the guide blocks differs between these Figures.

After the shifting operation, the motor M3A in the horizontal moving means 23 presses the guide blocks arranged in the guide block arrangement space S1 in the bottom stage for one pitch in the direction shown by arrow (f). The guide block No. 6 at the right end of the guide block arrangement space S1 in the bottom stage protrudes rightward from the space. The raising means raises the protruding guide block No. 6 to the guide block arrangement space S2 in the middle stage along the direction shown by arrow (g).

The first pusher 29 of the middle stage presses the raised guide block No. 6 for one pitch in the direction shown by arrow (h). This pressing operation causes the guide block No. 1 at the left end of the guide block arrangement space S2 in the middle stage to protrude leftward from the space. The raising means raises the protruding guide block No. 1 to the guide block arrangement space S3 in the top stage along the direction shown by arrow (i).

The raised guide block No. 1 is pressed for one block in the direction shown by arrow (j) using the motor M4A in the horizontal moving means 23. The moving operation from (f) through (j) corresponds to one cycle in the latter half (after shifting) of the process executed by the guide block moving means 22, and this cycle is repeated five times to perform shifting operations in order to return to the initial arrangement order as shown in FIG. 12A.

According to a three-dimensional weaving machine of the above configuration according to the above mentioned embodiment, in a biased yarn orientation apparatus that is a component of the three-dimensional weaving machine, which is extremely difficult to design, biased yarn guide blocks that orient biased yarns while supporting them in such a way that the yarns can be passed through the guide blocks are moved using a snake-like motion instead of being circularly moved along an annular track as in the prior art. This embodiment is highly effective, as it eliminates the need to operate circularly the feeding side of biased yarns, enables the biased yarn guide block to be miniaturized, and eliminates the need to move a guide block in the top stage into the gap between adjacent guide blocks in the bottom stage in order to avoid the complicated movement of the biased yarn guide blocks, thereby enabling three-dimensional woven fabrics of a large weaving width to be reliably woven using a compact apparatus.

Other embodiments of a biased yarn feeding apparatus are below described with reference to FIGS. 13 to 19.

This embodiment provides a biased yarn feeding apparatus for a three dimensional weaving machine comprising 2N guide blocks having a small diameter portion; a guide block receive and support means that forms guide block arrangement spaces in a top stage, and a bottom stage wherein N guide blocks can be arranged in each stage parallel and adjacent to one another; a vacant area forming means for advancing between the small diameter positions of adjacent guide blocks in either of the stages to move the adjacent guide blocks one block in the horizontal direction in order to form one block of vacant area so that a guide block in the other stage can advance into said vacant area; a shifting means for shifting a guide block that protrudes sideward from the space; and a pressing means for pressing the shifted guide blocks sideways in such a way as to move them one block in the horizontal direction.

Furthermore, according to this embodiment, the vacant area forming means comprises a pair of claw members that are alternately driven in the lateral direction and advances between the small diameter portions of adjacent guide blocks to move the guide blocks one block.

Furthermore, this embodiment provides a biased yarn feeding apparatus for a three-dimensional weaving machine comprising 2N guide blocks having a plurality of threading pipes that are used to pivotally connect the guide blocks together in such a way as to form a chain, and each including a catching groove; a guide block receive and support means that forms guide block arrangement spaces in a bottom and a top stages wherein N guide blocks can be arranged in each stage parallel and adjacent to one another; and a vacant area forming means that engages the catching groove in the guide block to move alternately the guide blocks in each stage one block in the horizontal direction in order to form one block of vacant area so that a guide block in the other stage can advance into said vacant area.

Figure 13:
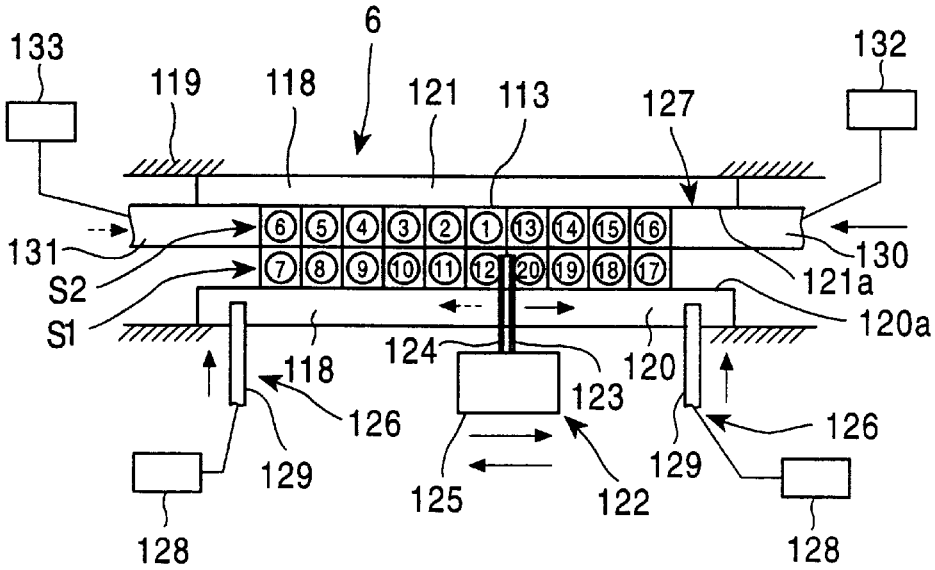
FIG. 13 is a schematic front view showing a basic configuration of a specific embodiment of a biased yarn feeding apparatus for a three-dimensional weaving machine based on a block 2-stage method according to the present invention.
Figure 14:
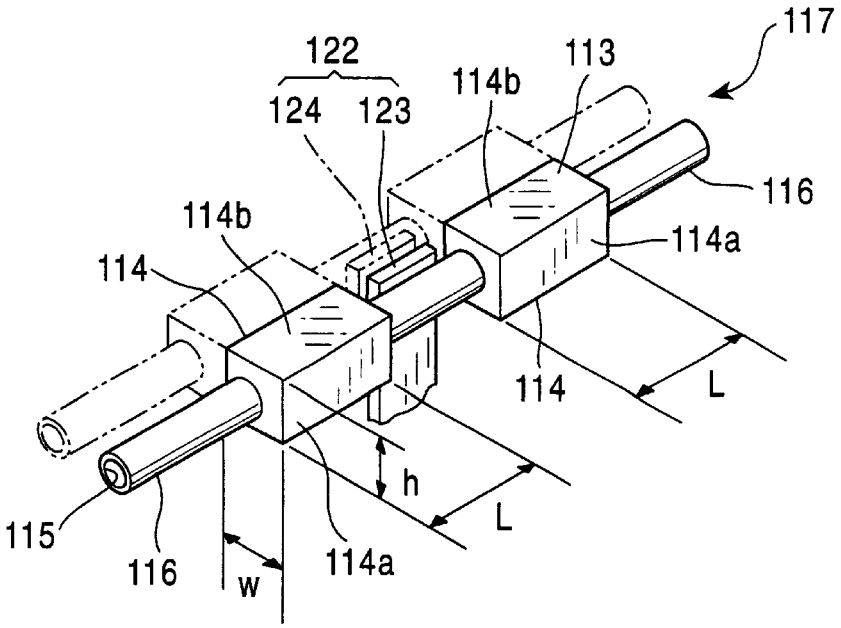
FIG. 14 is a perspective view showing a specific embodiment of biased yarn guide blocks.
Figure 15:
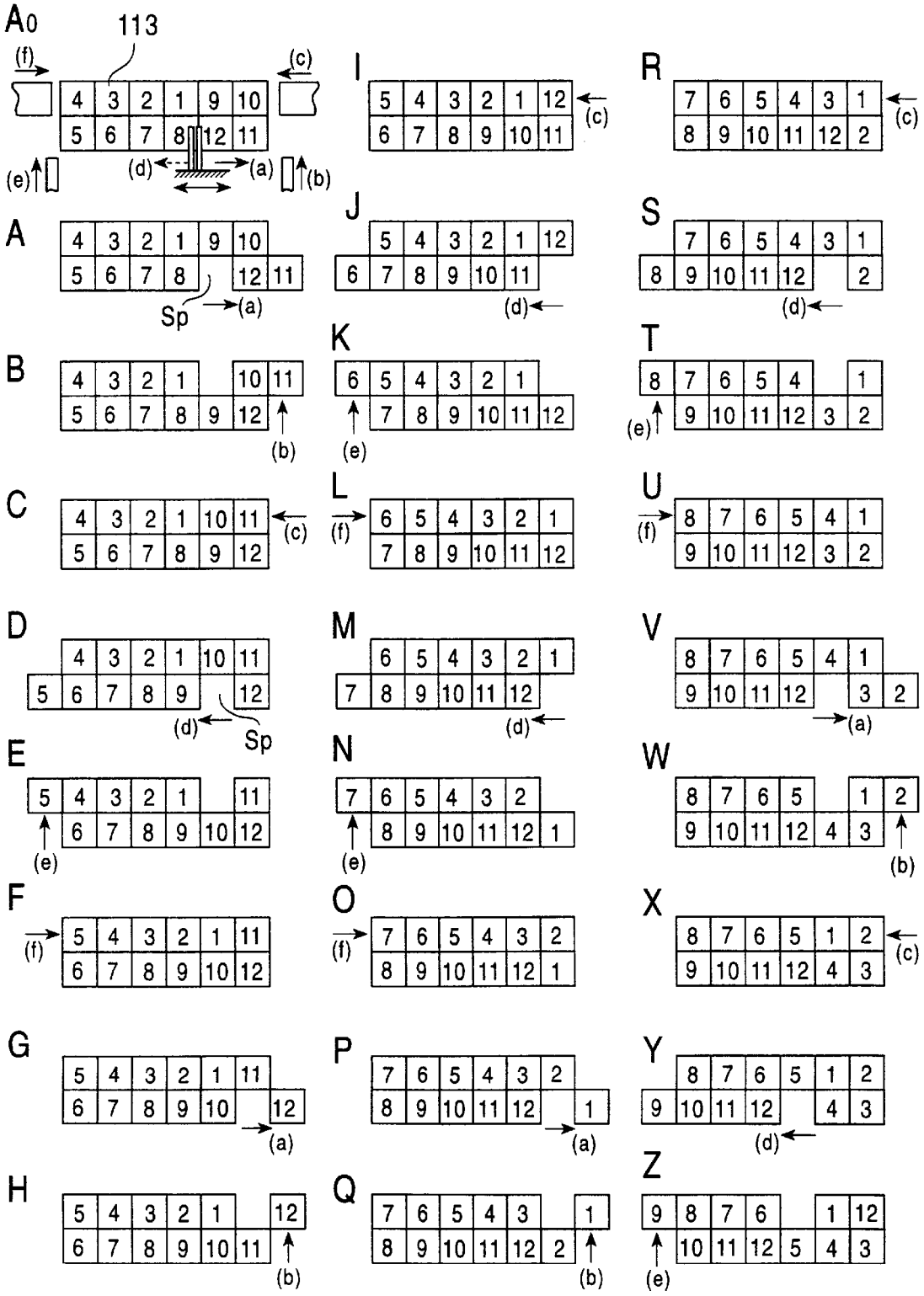
FIGS. 15$A_0$ to 15Z is a schematic front view showing the guide blocks as simplified blocks in order to describe the movement aspect of the guide blocks.

The biased yarn orientation apparatus 6 that is an integral part of the three-dimensional weaving machine according to this embodiment and that feeds biased yarns B1, B2 are now described in detail. FIGS. 13, 14 and 15 show a basic configuration of the two-block-stage biased yarn orientation apparatus 6 according to this embodiment and a specific example of a biased yarn guide block that guides a biased yarn.

First, a specific example of a biased yarn guide block 113 is explained with reference to FIG. 14. The biased yarn guide block 113 includes a pair of block bases 114, 114 having a width w, a height h, and length L and having a rectangular vertical cross section, and a pipe member 117 forming extension parts 116, 116 that penetrate the block bases 114, 114 in the length direction to extend outward from the respective length-wise ends of the block base 114 while forming a biased yarn through hole 115 that allows the biased yarn B to pass through along the lengthwise direction.

The biased yarn guide blocks 113 can be arranged in a matrix in such a way that adjacent guide blocks abut each other in the lateral and vertical directions using both sides 114*a*, 114*a* and top and bottom surfaces 114*b*, 114*b* of the block bases 114, 114. The width w of the block bases 114, 114 of the biased yarn guide block 113 corresponds to the weaving feeding pitch of the three-dimensional weaving machine. For a weaving feeding pitch of 4 mm, the width w is designed to be 4 mm. The height h of the block base 114, 114 is designed to correspond to two guide block arrangement spaces in a bottom stage and a top stage, which are described below, and is approximately 5 mm in a specific embodiment.

The biased yarn orientation apparatus 6 includes a guide block receiving and supporting means 118. The guide block receiving and supporting means 118 includes a lower guide rail member 120 and an upper guide rail member 121 mounted on a machine frame 119. The top surface 120*a* of the lower guide rail member 120 and the bottom surface 121*a* of the upper guide rail member 121 are mutually opposed in parallel. When the biased yarn guide blocks 113 are stacked on top of each other in the height direction, the upper and lower guide rail members 120, 121 form two guide block arrangement spaces S1 and S2 in a bottom stage and a top stage.

Furthermore, the biased yarn orientation apparatus 6 includes a vacant area forming means 122. The vacant area forming means 122 consists of a pair of claw members 123 and 124 that are alternately driven in the lateral direction, and advances between the small diameter portions of adjacent guide blocks to move them one block in the horizontal direction in order to form one block of vacant area, into which a guide block in the other stage can advance. In addition, the vacant area forming means 122 includes a reciprocating drive mechanism 125 on which the pair of the claw members 123, 124 are loaded in order to move them back and forth in the transverse direction.

Furthermore, the biased yarn orientation apparatus 6 includes a shifting means 126 for shifting the guide block 113 that has been allowed to protrude sidewardly from the corresponding space by the vacant area forming means 122, and a pressing means 127 for pressing sideways the shifted guide blocks a distance of one block in the transverse direction.

According to the embodiment shown in the figure, when the vacant area forming means 122 presses the guide block 113 arranged in the guide block arrangement space S1 in the bottom stage for a distance of one block in the transverse direction, the shifting means 126 raises the guide block 113 that protrudes sidewardly from the space to the guide block arrangement space S2 in the top stage. The shifting means 126 includes a vertical driven member 129 that is vertically moved by a cylinder apparatus 128, as shown in FIG. 13.

According to the embodiment shown in FIG. 13, the pressing means 127 comprises a first pusher 130 that pushes the guide block 113, which has been raised to the guide block arrangement space S2 in the top stage by the shifting means 126, for one pitch from right to left, and a second pusher 131 that pushes the guide block for one pitch from left to right. The first and second pushers 130 and 131 are mechanically connected to, for example, cylinder apparatuses 132 and 133, as shown in FIG. 13.

According to this embodiment, the vacant area forming means 122 and the shifting means 126 are not limited to the above embodiment, but the vacant area forming means 122 may be provided in the top stage to form a vacant area between guide blocks 113 arranged in the guide block arrangement space S2 in the top stage so that a guide block 113 in the bottom stage can be moved into the vacant area in the top stage. In addition, the shifting means 126 may be configured to enable a lowering function.

In the biased yarn orientation apparatus 6, the vacant area forming means 122 moves the guide blocks 113 in each stage 4 mm relative to a weave feeding pitch of 4 mm along the respective stage, thereby enabling the biased yarns B1 to be inserted at an angle of +45° relative to the warps X while enabling the biased yarns B2 at an angle of −45° relative to the warps X.

The unitary configuration of the biased yarn orientation apparatus 6 has been illustrated to describe its basic configuration, but actually, a plurality of sets of two biased yarn layers are commonly provided instead of the single set of biased yarn layers formed of the biased yarns B1, B2.

The moving aspect of the biased yarn guide blocks 113 in the biased yarn orientation apparatus 6 is explained with reference to FIG. 15. In FIG. 15, the vacant area forming means 122 forms a vacant area between the guide blocks 113 arranged in the guide block arrangement space S1 in the bottom stage and moves the guide block 113 in the top stage into the vacant area in the bottom stage, and the shifting means 126 is configured to enable a raising function. In FIG. 15, the number of the biased yarn guide blocks 113 is 12 for simplification, but the actual number of the biased yarn guide blocks 113 is 2N and may be 750 to weave three-dimensional woven fabrics of 3 m weaving width at a pitch of 4 mm.

First, in FIG. 15$A_0$, the guide block arrangement space S2 in the top stage is full of the guide blocks Nos. 4 to 1 arranged from left to right and guide blocks Nos. 10 and 9 arranged from right to left. The guide block arrangement space S1 in the bottom stage is full of guide blocks Nos. 5 to 8 arranged from left to right and guide blocks Nos. 11 and 12 arranged from right to left.

Next, the pair of the claw members 123, 124 in the vacant area forming means 122 are moved into the space between the small diameter portion of the guide blocks Nos. 8 and 12 in the guide block arrangement space S1 in the bottom stage, and the claw member 123 presses the guide block No. 12 for one pitch in the direction shown by arrow (a) to form a vacant area Sp as shown in FIG. 15A, while causing the guide block No. 11 at the right end to protrude rightward from the space.

In FIG. 15B, the guide block No. 9 in the guide block arrangement space S2 in the top stage falls freely into the vacant area Sp formed in the guide block arrangement space S1 in the bottom stage. On the other hand, the shifting means 126 raises the guide block No. 11 protruding rightward to the guide block arrangement space S2 in the top stage along the direction shown by arrow (b).

The first pusher 130 presses the raised guide block No. 11 for one pitch in the direction shown by arrow (c). This pressing operation fills the guide block arrangement spaces S1 and S2 in the top and bottom stages with the guide blocks, which are each shifted by one pitch, as shown in FIG. $15A_0$.

The pair of claw members 123, 124 in the vacant area forming means 122 are then moved into the space between the small diameter portion of the guide blocks Nos. 9 and 12 in the guide block arrangement space S1 in the bottom stage, and the claw member 124 presses the guide block No. 9 for one block in the direction shown by arrow (d) to form a vacant area Sp while causing the guide block No. 5 at the left end to protrude leftward from the space as shown in FIG. 15D.

In FIG. 15E, the guide block No. 10 in the guide block arrangement space S2 in the top stage falls freely into the vacant area Sp formed in the guide block arrangement space S1 in the bottom stage. On the other hand, the shifting means 126 raises the guide block No. 5 protruding leftward to the guide block arrangement space S2 in the top stage along the direction shown by arrow (e).

The second pusher 131 presses the raised guide block No. 5 for one pitch in the direction shown by arrow (f). This pressing operation fills the guide block arrangement spaces S1 and S2 in the top and bottom stages with the guide blocks, which are each shifted by one pitch, as shown in FIG. $15A_0$.

According to this embodiment, the moving operation from (A) to (C) and from (D) to (F) corresponds to one cycle in the moving aspect of the guide blocks, and this cycle can be repeated to move the guide blocks into a desired state. According to the embodiment shown in FIG. 15, when the vacant area forming means 122 reaches the right end, the operation changes to the moving operation from (D) to (F) and from (A) to (C), and the vacant area forming means 122 is then operated in the opposite direction by the reciprocating drive means 125, as shown in FIG. 15L.

Figure 16:
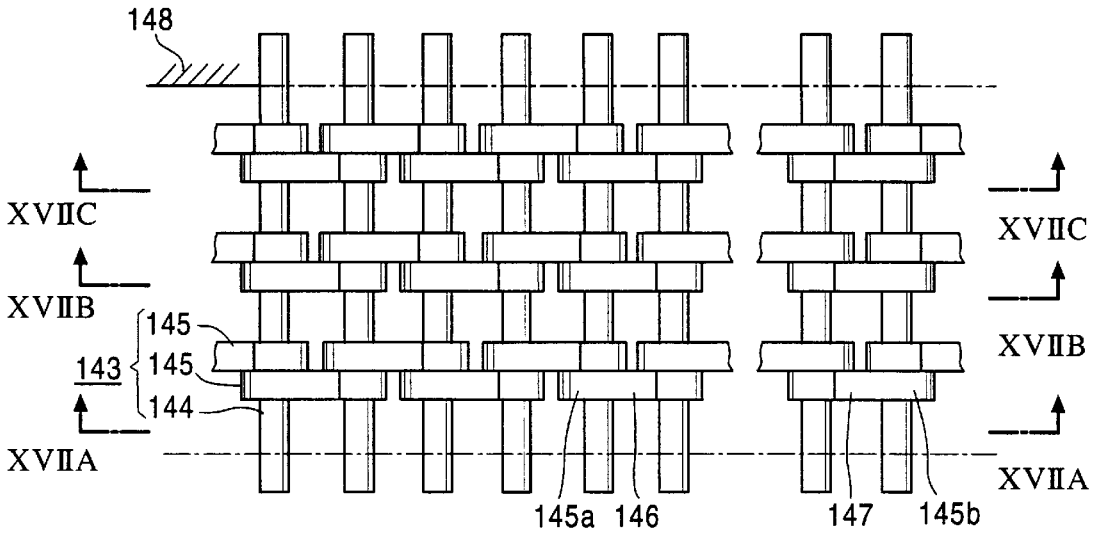
FIG. 16 is a partly broken schematic top view showing a specific embodiment of a biased yarn feeding apparatus for a three-dimensional weaving machine based on a chain 2-stage method according to the present invention.
Figure 17A:
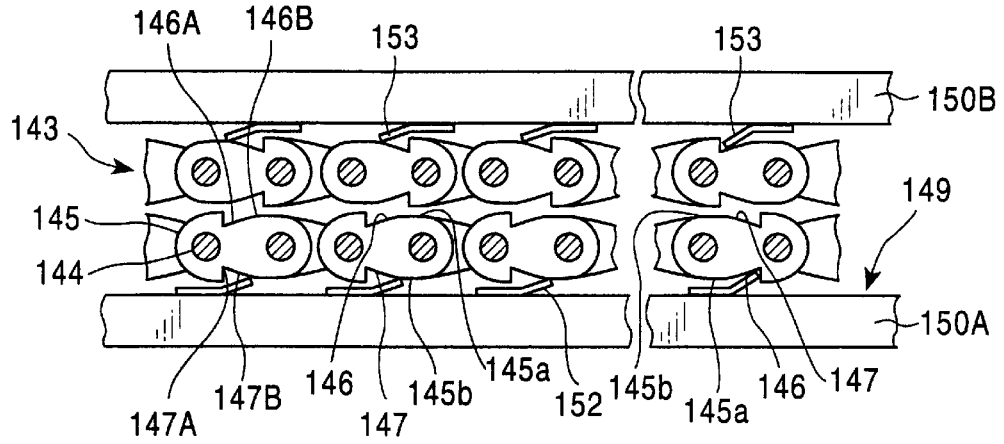
FIG. 17A is a schematic front view taken along line XVIIA—XVIIA in FIG. 16 as seen from the direction shown by the arrow.
Figure 17B:
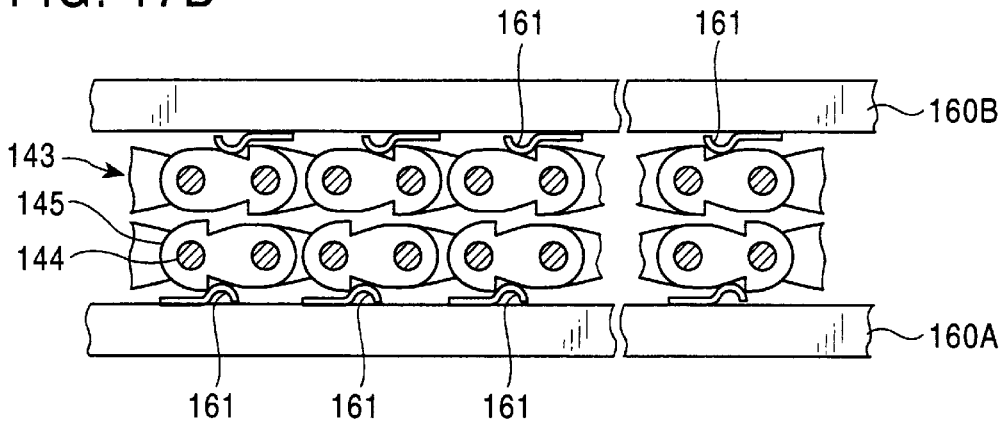
FIG. 17B is a schematic front view taken along line XVIIB—XVIIB in FIG. 16 as seen from the direction shown by the arrow.
Figure 17C:
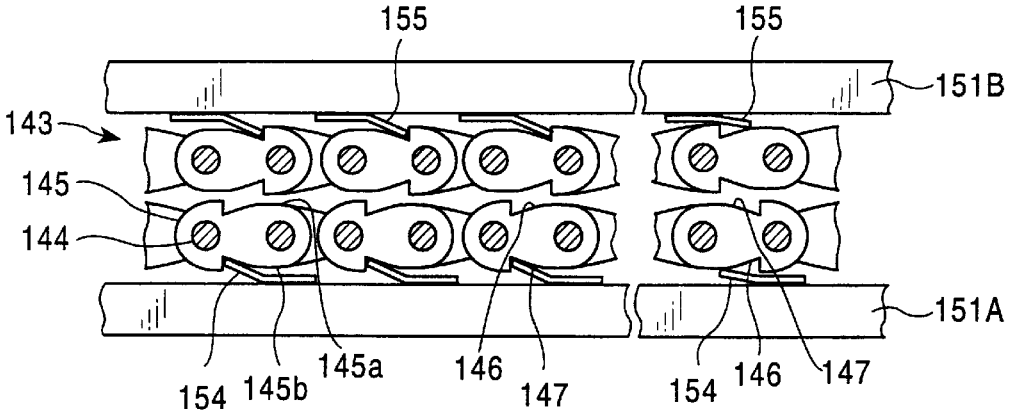
FIG. 17C is a schematic front view taken along line XVIIC—XVIIC in FIG. 16 as seen from the direction shown by the arrow.

An example of a chain 2-stage configuration according to this embodiment is now described with reference to FIGS. 16 to 19. FIG. 16 is a partly-broken schematic top view showing a specific example of a bias feeding apparatus in a three-dimensional weaving machine that is based on the chain 2-stage method. FIG. 17 is a front view of FIG. 16. FIG. 17A is a schematic front view of FIG. 16 as seen along line XVIIA—XVIIA from the direction shown by the arrow, FIG. 17B is a schematic front view of FIG. 16 as seen along line XVIIB—XVIIB from the direction shown by the arrow, and FIG. 17C is a schematic front view of FIG. 16 as seen along line XVIIC—XVIIC from the direction shown by the arrow.

According to this embodiment, the biased yarn guide block 143 that guides a biased yarn consists of a plurality of threading pipes 144 and a plurality of block bases 145 pivotally connected together via the threading pipes 144 in order to form a chain. Catching grooves 146, 147 are provided in one of the surfaces 145*a* and the other surface 145*b*, respectively, of the block base 145. The catching grooves 146, 147 are one-way grooves, and has catching portions 146A and 147A, respectively, on which feeding claws, which are described below, are caught when advancing rightward relative to the guide blocks 143 arranged in the bottom stage in FIG. 17A, and non-catching portions 146B, 147B on which the feeding claws are not caught.

The guide blocks 143 are movably received and supported along the guide block arrangement spaces S1 and S2 in the bottom and top stages that can be arranged in parallel, by a guide block receiving and supporting means 148 that forms the guide block arrangement spaces S1 and S2 in the bottom and top stages.

Furthermore, the biased yam orientation apparatus 6 includes a vacant area forming means 149. The vacant area forming means 149 consists of two sets of a vertical pair of feeding claw slide bar members 150A, 150B, 151A, and 151B that are alternatively driven in the lateral direction. According to the embodiment shown in FIGS. 17A and 17C, a plurality of the feeding claws 152 facing in a direction suitable for feeding from left to right the guide blocks arranged in the guide block arrangement space S1 in the bottom stage are provided on the feeding claw slide bar member 150A, a plurality of the feeding claws 153 facing in a direction suitable for feeding from right to left the guide blocks arranged in the guide block arrangement space S2 in the top stage are provided on the feeding claw slide bar member 150B, a plurality of the feeding claws 154 facing in a direction suitable for feeding from right to left the guide blocks arranged in the guide block arrangement space S1 in the bottom stage are provided on the feeding claw slide bar member 151A, and a plurality of the feeding claws 155 facing in a direction suitable for feeding from left to right the guide blocks arranged in the guide block arrangement space S2 in the top stage are provided on the feeding claw slide bar member 151B.

The two sets of a vertical pair of the feeding claw slide bar members 150A, 150B, 151A, and 151B include the drive means 156, 157, 158 and 159, respectively, that can alternately drive the feeding claw slide bar members 150A, 150B, 151A and 151B rightward or leftward.

According to the embodiment shown in FIGS. 16 and 17B, a vertical pair of the positioning slide bar members 160A, 160B are provided between the two sets of a vertical pair of the feeding claw slide bar members 150A, 150B, 151A and 151B. A plurality of the positioning claws 161 that are elastically resiliently fitted in the catching grooves 146, 147 in the guide block are provided on the positioning slide bar members 160A, 160B, respectively.

In the biased yarn orientation apparatus 6, the vacant area forming means 149 moves the guide blocks 143 in each stage 4 mm relative to a weave feeding pitch of 4 mm along the respective stage to enable the biased yarns B1 to be inserted at an angle of +45° relative to the warps X while enabling the biased yarns B2 to be inserted at an angle of −45° relative to the warps X.

The unitary configuration of the biased yarn orientation apparatus 6 has been illustrated to describe its basic configuration, but actually, a plurality of sets of two biased yarn layers are commonly provided instead of the single set of biased yarn layers formed of the biased yams B1, B2.

The moving aspect of the biased yarn guide blocks 143 in the biased yarn orientation apparatus 6 is explained with reference to FIG. 18. In FIG. 18, the number of biased yarn guide blocks is 20 for simplification, but the actual number of biased yarn guide blocks is 2N and may be 750 to weave three-dimensional woven fabrics of 3 m weaving width at a pitch of 4 mm.

Figure 18A:
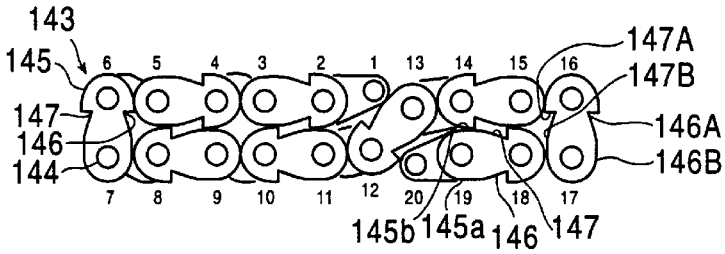
FIGS. 18A to 18G is a schematic front view describing the movement aspect of chain guide blocks according to the chain 2-stage method.

First, in FIG. 18A, biased yarn guide blocks Nos. 1 to 6 are arranged in the guide block arrangement space S2 in the top stage from middle to left, biased yarn guide blocks Nos. 7 to 12 are arranged in the guide block arrangement space S1 in the bottom stage from left end to middle, biased yarn guide blocks Nos. 13 to 16 are arranged in the guide block arrangement space S2 in the top stage from middle to right, and biased yarn guide blocks Nos. 17 to 20 are arranged in the guide block arrangement space S1 in the bottom stage from right end to middle.

Figure 18B:
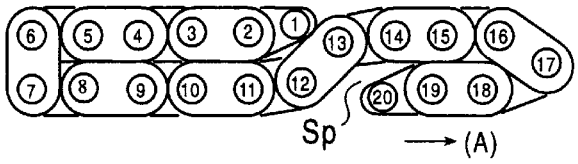

Then the feeding claw slide bar member 150A in the vacant area forming means 122 is driven rightward to press the biased yarn guide blocks Nos. 20 to 17 arranged in the guide block arrangement space S1 in the bottom stage, for one pitch rightward in the direction shown by arrow (A), thereby forming the vacant area Sp to cause the biased yarn guide block No. 17 at the right end to protrude rightward from the space, as shown in FIG. 18B.

Figure 18C:
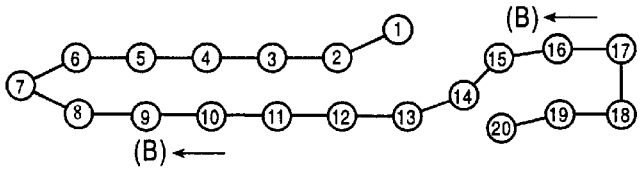
Figure 18D:
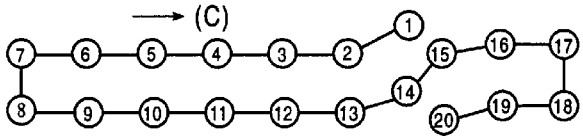
Figure 18E:
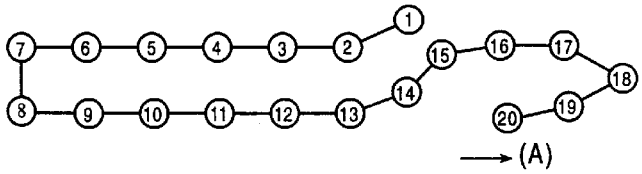
Figure 18F:
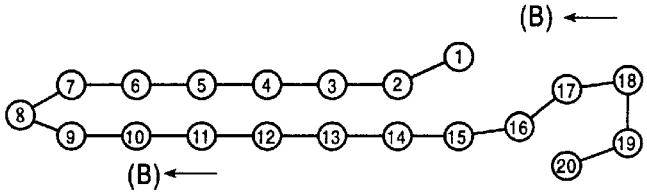
Figure 18G:
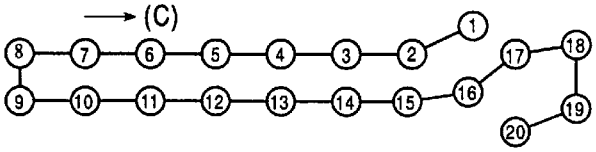
Figure 19:
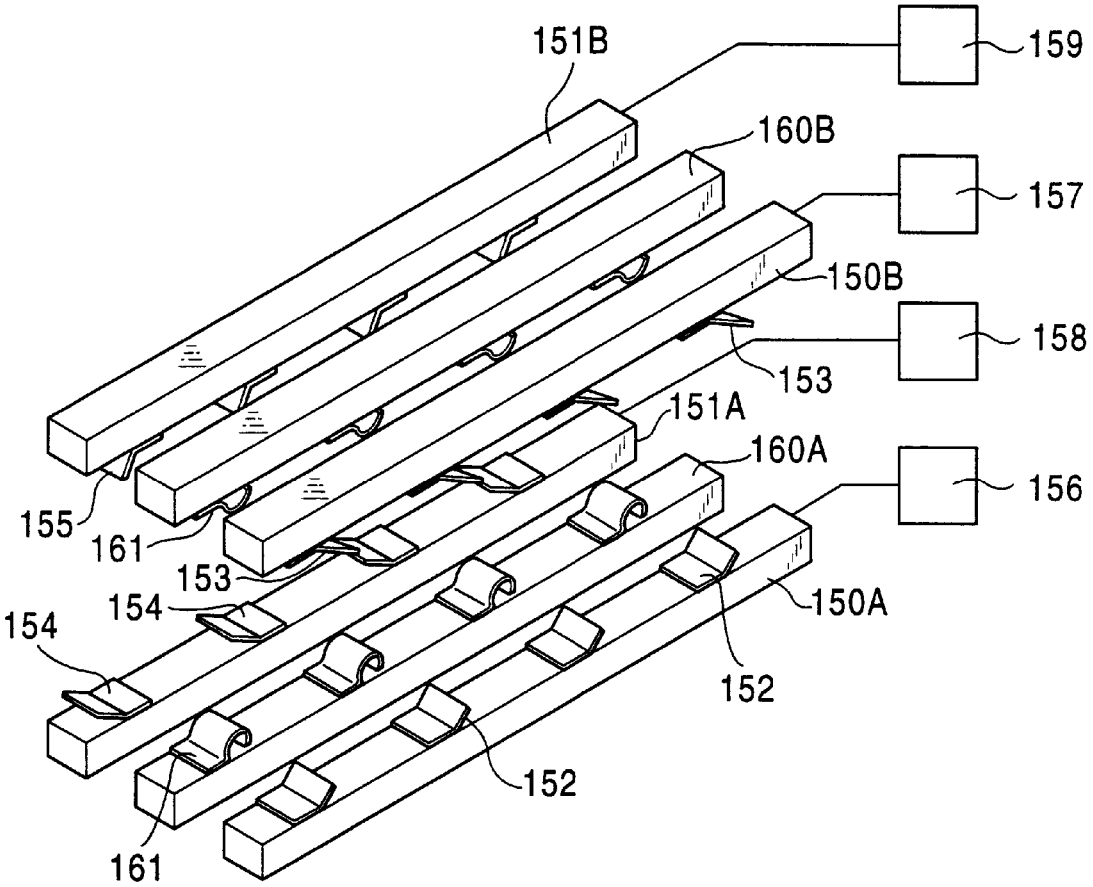
FIG. 19 is a schematic perspective view showing a specific embodiment of a drive means according to the chain 2-stage method.

Then, the feeding claw slide bar members 151A and 151B in the vacant area forming means 122 are driven leftward to press the biased yarn guide blocks Nos. 16 to 13 arranged in the guide block arrangement space S2 in the top stage, for one pitch rightward while pressing the biased yarn guide blocks Nos. 12 to 7 arranged in the guide block arrangement space S1 in the bottom stage, for one pitch leftward in the direction shown by arrow (B), thereby forming the vacant area Sp to cause the biased yarn guide block No. 7 at the left end to protrude leftward from the space, as shown in FIG. 18C.

The feeding claw slide bar member 150B in the vacant area forming means 122 is then driven rightward to press the biased yarn guide blocks Nos. 6 to 1 arranged in the guide block arrangement space S2 in the top stage, for one pitch rightward while drawing the biased yarn guide block No. 7 up to the guide block arrangement space S2 in the top stage.

According to this embodiment, the moving operation from (A) to (C) corresponds to one cycle in the moving aspect of the biased yarn guide blocks, and this cycle can be repeated to move the guide blocks into a desired state.

According to a three-dimensional weaving machine of the above configuration according to this embodiment, in a biased yarn orientation apparatus that is a component of the three-dimensional weaving machine, which is extremely difficult to design, biased yarn guide blocks that orient biased yarns while supporting them in such a way that the yarns can be passed through the guide blocks are moved using a snake-like motion instead of being circularly moved along an annular track as in the prior art. This makes the embodiment highly effective, as it eliminates the need to circularly operate the feeding side of biased yarns, enables the biased yarn guide block to be miniaturized, and avoids the complicated movement of the biased yarn guide blocks, thereby enabling three-dimensional woven fabrics of a large weaving width to be reliably woven using a compact apparatus.

Furthermore, according to the block 2-stage method used in this embodiment, the pair of claw members advance between the small diameter portions to form a vacant area, thereby enabling a more reliable snake-like motion to be achieved using smaller guide blocks. In addition, according to this method, the plurality of guide blocks are connected together, and a reliable snake-like motion can be achieved without the need to change of the order of the guide blocks. This configuration makes this embodiment highly effective.

The vertical yarn insertion apparatus according to this embodiment is now described with reference to FIGS. 20 to 31.

In a conventional three-dimensional weaving machine, warps and biased yarns are guided to the fell cloths, while vertical yarns are inserted from above or below the warps and biased yarns. This operation, however, does not reliably connect the warps, wefts, and biased yarns together, resulting in variations of the strength of woven fabrics in the thickness direction.

It is an object of this embodiment to provide a three-dimensional weaving machine that reliably connects warps, wefts, and biased yarns together in order to uniformize the strength of woven fabrics in the thickness direction.

According to this embodiment, warps and biased yarns are guided to cloth fell, an upper vertical yarn insertion member inserts vertical yarns from above the warps and biased yarns, and a lower vertical yarn insertion member inserts the vertical yarns from below the warps and biased yarns.

Preferably, a plurality of upper vertical yarn insertion members and a plurality of lower vertical yarn insertion members are alternately arranged along the width direction of a woven fabric.

Furthermore, after the vertical yarns have been inserted, the upper and lower vertical yarn insertion members are moved toward the cloth fell in order to enable a beating motion.

This embodiment is described below.

FIG. 1 shows a three-dimensional weaving machine for weaving a three-dimensional 5-axis woven fabric W which has a plurality of beams 2. The warps X, biased yarns B1, B2, and vertical yarns Z are wound around the beam 2. The warps X, biased yarns B1, B2, and vertical yarns Z are supplied from each beam 2, pass through dancer rollers 3, and are then guided by split guide plates 4 to frames 5.

Figure 20:
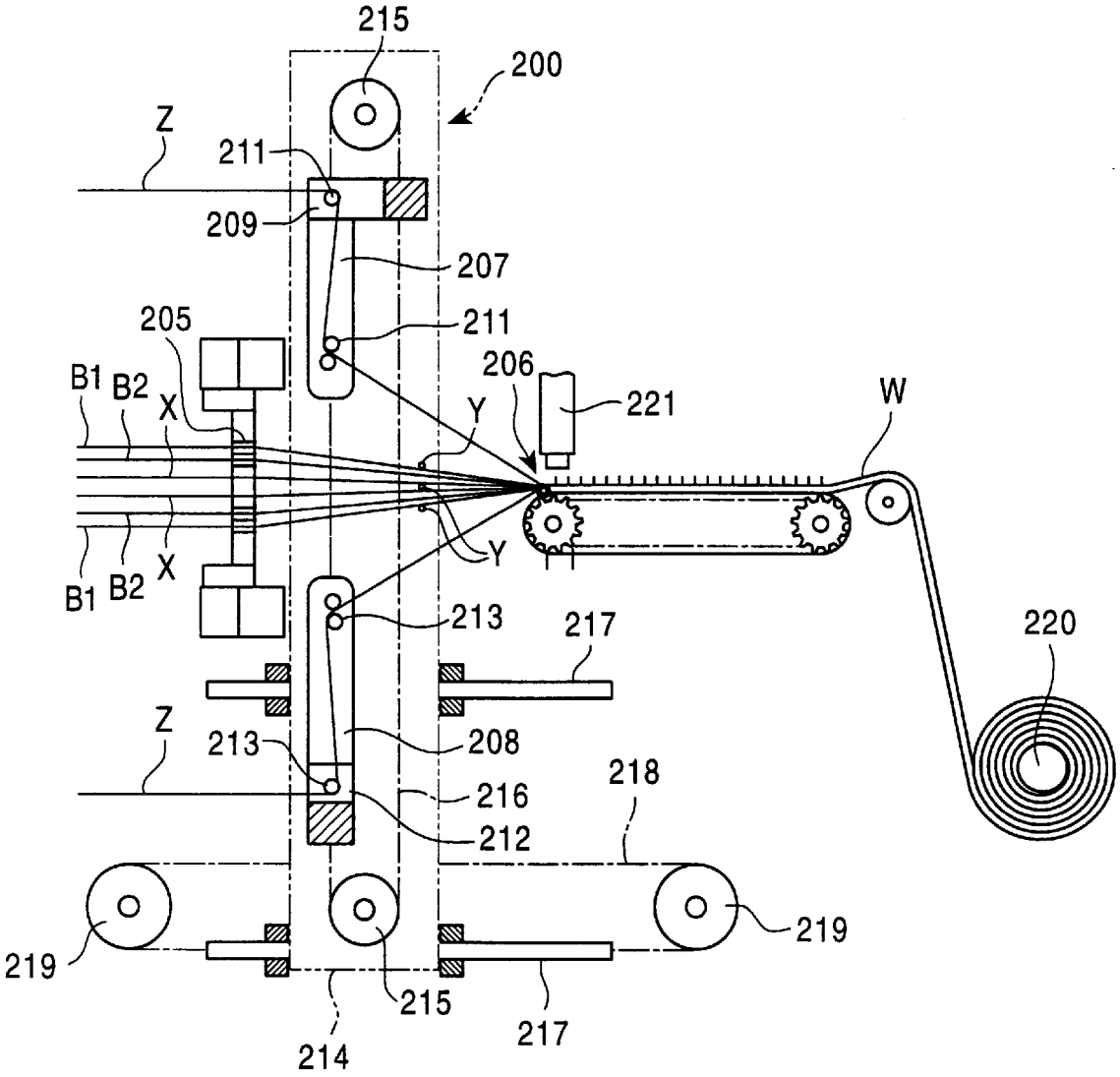
FIG. 20 is a side sectional view of the three-dimensional weaving machine in FIG. 1.

In the frame 5, the warps X and the biased yarns B1 and B2 pass through a biased yarn orientation apparatus 205, and are guided to cloths fell 206, where the warps X are formed into a plurality of warp-layers while the biased yarns B1, B2 are formed into a set of two biased yarn-layers, which are located on the respective sides of the warp-layers, as shown in FIG. 20. The biased yarn orientation apparatus 205 operates the biased yarns B1, B2 in such a way that the biased yarns B1 in one of the layers are tilted at an angle of +45° relative to the warps X whereas the biased yarns B2 in the other layer are tilted at an angle of −45° relative to the warps X.

Furthermore, a weft insertion apparatus inserts the wefts Y between the warp-layers and outside the biased layers.

Furthermore, a vertical yarn insertion apparatus 200 inserts the vertical yarns Z. Between the biased yarn orientation apparatus 205 and the cloth fell 206, the vertical yarn insertion apparatus 200 has an upper vertical yarn insertion member 207 and a lower vertical yarn insertion member 208. The upper vertical yarn insertion member 207 is located above the warps X and the biased yarns B1, B2, while the lower vertical yarn insertion member 208 is located below the warps X and the biased yarns B1, B2.

Figure 21:
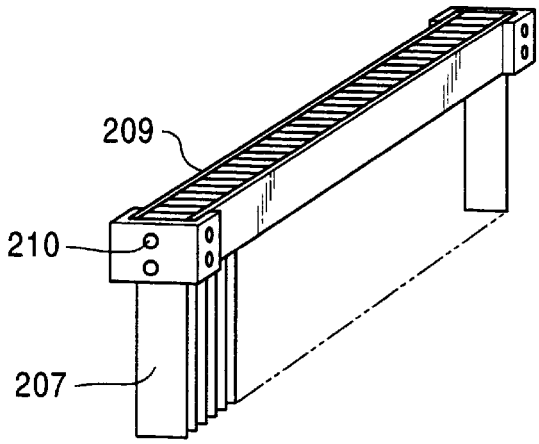
FIG. 21 is a perspective view of an upper vertical yarn insertion member in FIG. 20.
Figure 22:
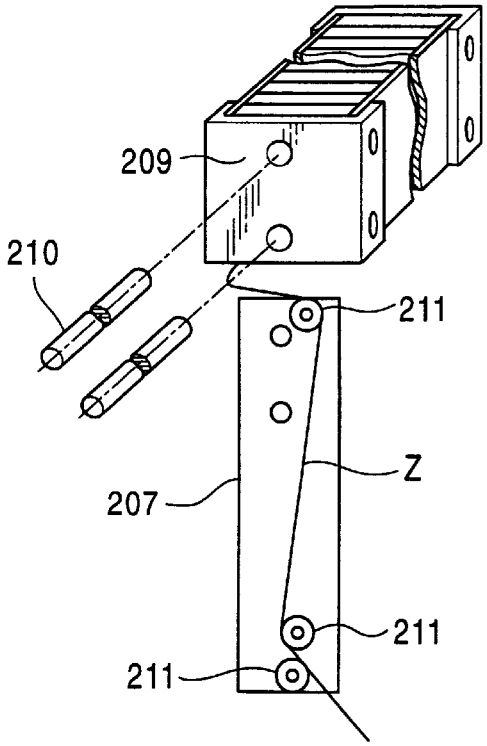
FIG. 22 is an exploded view of the upper vertical yarn insertion member in FIG. 21.

As shown in FIGS. 21 and 22, a plurality of plate-like upper vertical yarn insertion members 207 are used and arranged in the yarn arrangement direction of the warp- and biased yarn layers, and their upper ends are inserted into a case 209 and are connected together using pins 210. The plurality of the vertical yarns Z are guided to above the case 209, and are each inserted between the upper vertical yarn insertion members 207. Furthermore, a plurality of guide rollers 211 are attached to each upper vertical yarn insertion member 207, and the vertical yarns Z pass through the guide rollers 211 and are guided to the cloths fell 206.

A plurality of plate-like lower vertical yarn insertion members 208 are also arranged in the yarn arrangement direction of the warp- and biased yarn layers. Thus, the plurality of upper vertical yarn insertion members 207 and the plurality of the lower vertical yarn insertion members 208 are alternately arranged in the width direction of woven fabrics. Furthermore, contrary to the upper vertical yarn insertion members 207, the lower ends of the lower vertical yarn insertion members 208 are inserted into the case 212 and connected using pins. The plurality of vertical yarns Z are guided to below the case 212 and are each inserted between the lower vertical yarn insertion members 208. Furthermore, a plurality of guide rollers 213 are attached to each lower vertical yarn insertion member 208, and the vertical yarns Z pass through the guide rollers 213 and are guided to the cloth fell 206.

Furthermore, the cases 209 and 212 for the upper and lower vertical yarn insertion members 207 and 208 are supported and guided by a carriage 214 to enable them to be elevated and lowered. Sprockets 215 are provided in the carriage 214, and a chain 216 engages the sprockets 215. On the side of one of the sprockets 215, the case 209 for the upper vertical yarn insertion member 207 is connected to the chain 216, whereas on the side of the other sprocket 215, the case 212 for the lower vertical yarn insertion member 208 is connected to the chain 216. Thus, the chain 216 can be used to lower the case 209 and the upper vertical yarn insertion member 207 while elevating the case 212 and the lower vertical yarn insertion member 208. In the thickness direction of the warp-layers and biased yarn-layers, the upper and lower vertical yarn insertion members 207 and 208 can be passed between the warps X in each layer and between the biased yarns B1, B2, and the vertical yarns Z can also be passed between the warps X in each layer and between the biased yarns B1, B2, as described below.

The carriage 214 is supported and movably guided by a guide rod 217. Furthermore, a chain 218 engages sprockets 219 and the carriage 214 is connected to the chain 218. Thus, the chain 218 can be used to move the carriage 214. Consequently, after the insertion of the vertical yarns Z, the upper and lower vertical yarn insertion members 207 and 208 can be moved to the cloth fell 206 in order to enable a beating motion.

This configuration enables three-dimensional 5-axis woven fabrics W to be woven using the warps X, the wefts Y, the biased yarns B1, B2, and the vertical yarns Z and to be wound around a winding shaft 220. Furthermore, this weaving machine has a press member 221 that compresses the woven fabrics W and that is provided near the cloth fell 206.

Figure 23:
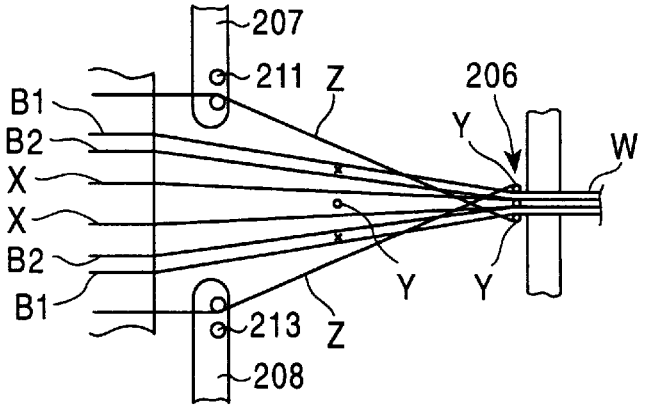
FIG. 23 is an explanatory drawing showing a weaving process executed by the three-dimensional weaving machine in FIG. 20.

According to this three-dimensional weaving machine, three wefts Y are inserted between the warp-layers and outside the biased yarn-layers. Then, as shown in FIG. 23, one weft Y is inserted between the layers of the warps X. Subsequently, three wefts Y and one weft Y is similarly inserted again, and these operations are alternated.

Figure 24:
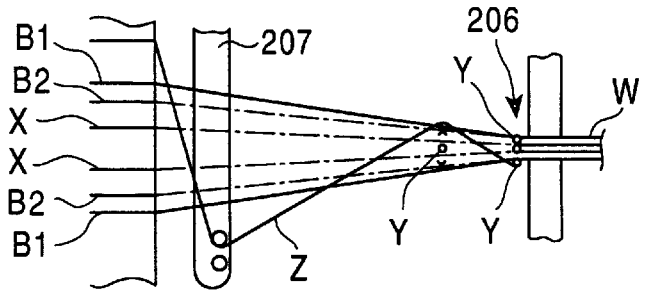
FIG. 24 is an explanatory drawing showing a process executed next to the process in FIG. 23.

When the one weft Y is inserted between the layers of the warps X, the chain 216 drives the upper and lower vertical yarn insertion members 207, 208 to lower the upper vertical yarn insertion member 207 while elevating the lower vertical yarn insertion member 208. Thus, in the thickness direction of the layers of the warps X and the layers of the biased yarns B1, B2, the upper vertical yarn insertion member 207 is passed between the warps X in each layer and between the biased yarns B1, B2, and the vertical yarns Z are also passed between the warps X in each layer and between the biased yarns B1, B2, as shown in FIG. 24. At the same time, the lower vertical yarn insertion member 208 is passed between the warps X in each layer and between the biased yarns B1, B2, and the vertical yarns Z are also passed between the warps X in each layer and between the biased yarns B1, B2. Thus, the upper vertical yarn insertion member 207 inserts vertical yarns Z from above the warps X and the biased yarns B1, B2, and at the same time, the lower vertical yarn insertion member 208 inserts vertical yarns Z from below the warps X and the biased yarns B1, B2.

Figure 25:
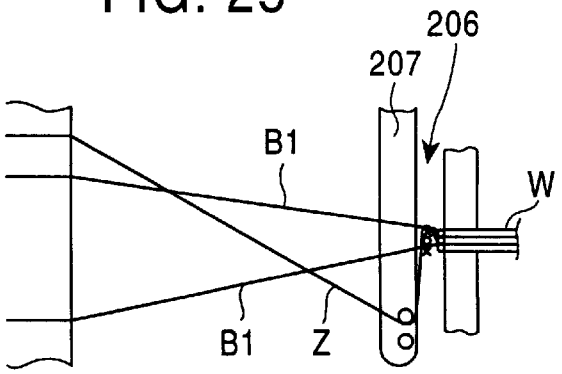
FIG. 25 is an explanatory drawing showing a process executed next to the process in FIG. 24.

Subsequently, the chain 218 drives the carriage 214 to cause the upper and lower vertical yarn insertion members 207 and 208 to advance toward the cloth fell 206 for a beating operation, as shown in FIG. 25. Furthermore, according to this embodiment, the press member 221 simultaneously compresses the woven fabric W near the cloth fell 206, and the upper vertical yarn insertion member 207 is lowered slightly, whereas the lower vertical yarn insertion member 208 is elevated slightly. This operation tightens the vertical yarns Z. With the woven fabric W compressed, the press member 221 moves in the feeding direction of the woven fabric W in order to feed the woven fabric W. The distance over which the woven fabric W is fed is approximately 2 mm. The woven fabric W is then wound around the winding shaft 220.

Figure 26:
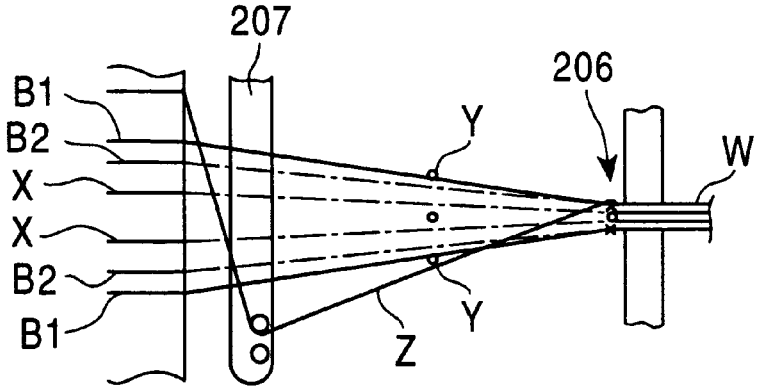
FIG. 26 is an explanatory drawing showing a process executed next to the process in FIG. 25.
Figure 27:
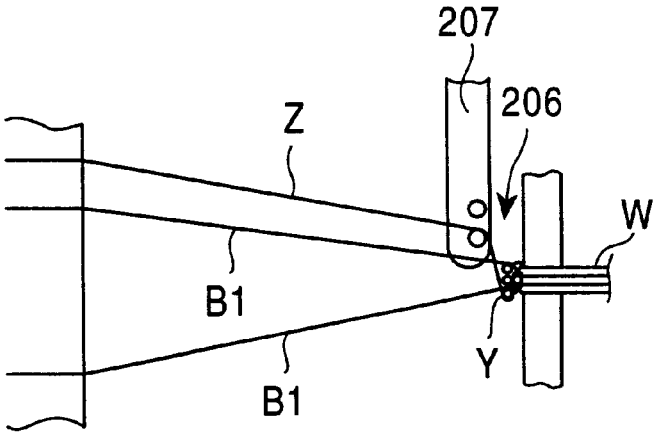
FIG. 27 is an explanatory drawing showing a process executed next to the process in FIG. 26.

Then, as shown in FIG. 26, the chain 218 drives the carriage 214 to move the upper and lower vertical yarn insertion members 207 and 208 backward from the cloth fell 206. Subsequently, three wefts Y are inserted between the layers of the warps X and outside the layers of the biased yarns B1, B2, and outside the layers of the biased yarns B1, B2, these wefts Y are inserted between the biased yarns B1, B2 and between the vertical yarns Z. Subsequently, the upper and lower vertical yarn insertion members 207 and 208 advance toward the cloth fell 206 for a beating operation, as shown in FIG. 27. At the same time, the press member 221 compresses the woven fabric W, and the upper vertical yarn insertion member 207 is elevated slightly, whereas the lower vertical yarn insertion member 208 is lowered slightly, thereby causing the vertical yarns Z to be tightened. Furthermore, the press member 221 moves in the feeding direction of the woven fabric W to feed the woven fabric W. The distance over which the woven fabric W is fed is also approximately 2 mm. The woven fabric W is then wound around the winding shaft 220.

Subsequently, the upper vertical yarn insertion member 207 elevates to the position shown in FIG. 23, whereas the lower vertical yarn insertion member 208 lowers to the position shown in FIG. 23. One weft Y is then inserted between the layers of the warps X, and the above steps are repeated. This process allows a three-dimensional 5-axis woven fabric W to be woven.

Figure 28:
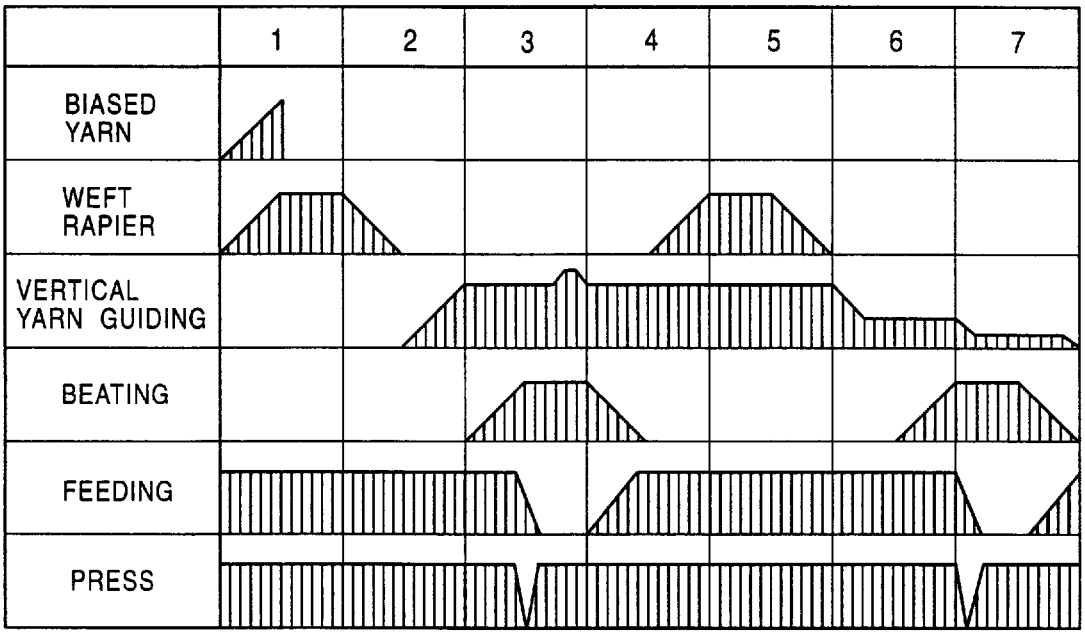
FIG. 28 is a diagram showing the operation of each member wherein the vertical axis represents the position and the horizontal axis represents time.

FIG. 28 is a diagram showing the operation of each member wherein the vertical axis indicates positions while the horizontal axis indicates time. The "weft rapier" in this diagram indicates the movement of a rapier in the weft insertion apparatus, and the lower side of this row denotes an insertion port side while the upper side denotes the opposite side. The "vertical yarn guiding" indicates the vertical movement of the vertical yarn insertion members 207 and 208, and the lower side of this row denotes the state prior to insertion while the upper side denotes the state after insertion. The small protrusion in the middle of this row indicates that during a beating operation, the upper vertical yarn insertion member 207 is raised slightly whereas the lower vertical yarn insertion member 208 is lowered slightly in order to tighten the woven fabric W. Furthermore, the "beating" indicates the horizontal movement of the vertical yarn insertion members 207 and 208, and the lower side of this row denotes the state in which these members have moved to their rear-most positions while the upper side denotes the state in which they have moved forward to the position of the cloth fell. The "feeding" indicates the horizontal movement of the press member 221, and the lower side of this row denotes the state in which the press member is located on the upstream side (close to the position of the cloth fell) while the upper side denotes the state in which the press member is located on the downstream side (far from the position of the cloth fell). In other words, a feeding operation is performed when the diagram is tilted rightward and upward, whereas a returning operation is performed when the diagram is tilted rightward and downward. The "press" indicates the vertical movement of the press member 221 (the movable portion), and the lower side of this row denotes the state in which the press member is opened, whereas the upper side denotes the state in which the press member sandwiches yarns.

Basically, the press member 221 constantly presses the woven fabric W immediately after the position of the cloth fell and is momentarily opened (the movable portion is raised) only when the returning operation is to be performed. The press member 221, however, is opened only during the beating operation (when the vertical yam insertion members 207 and 208 advance to the position of the cloth fell). Therefore, the position of the cloth fell is not displaced even when the press member 221 is opened.

Figure 29:
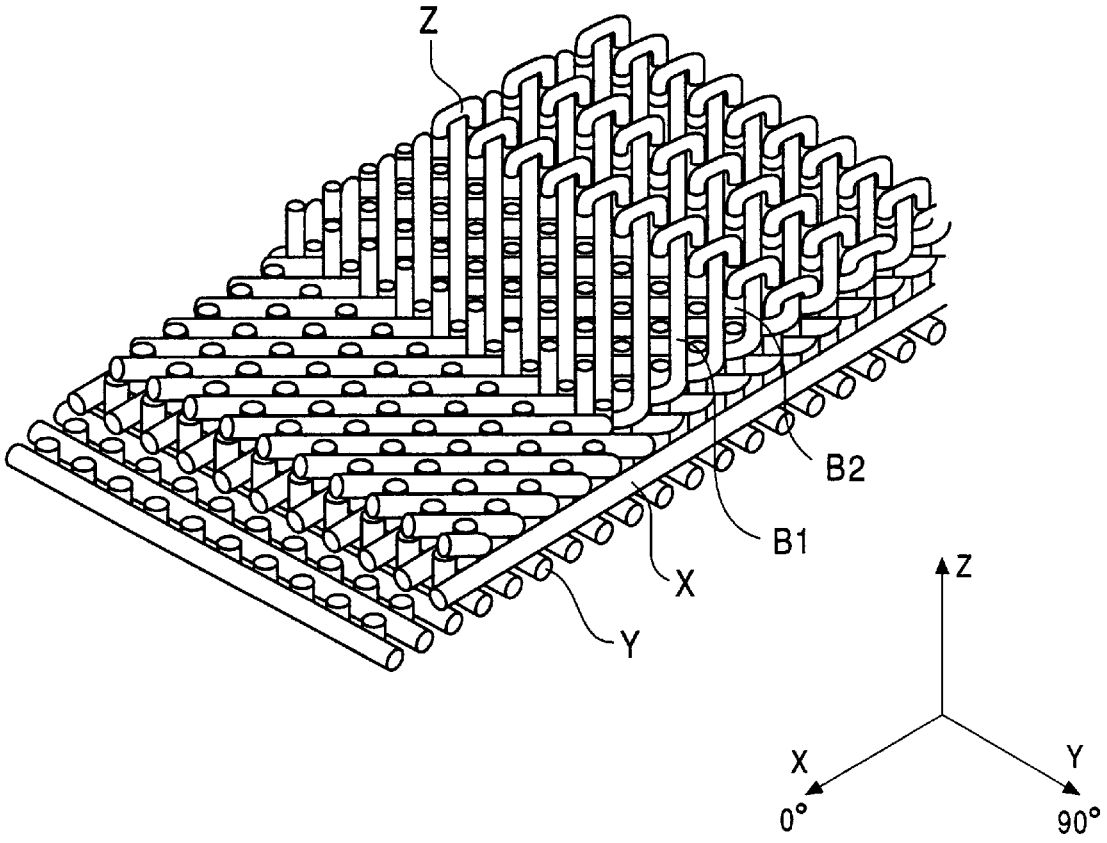
FIG. 29 shows the organization of a three-dimensional 5-axis woven fabric produced by using either the upper or lower vertical yarn insertion member.

FIG. 29 shows a three-dimensional 5-axis woven fabric W that is produced using either the upper or lower vertical yarn insertion member 207 or 208.

Figure 30:
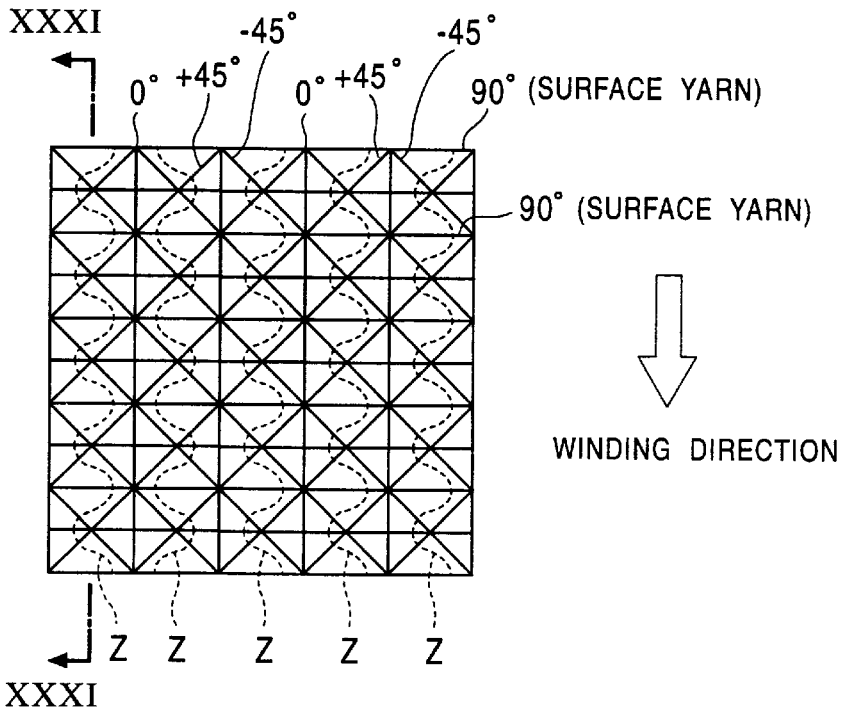
FIG. 30 is a top view of the three-dimensional 5-axis woven fabric in FIG. 20.
Figure 31:
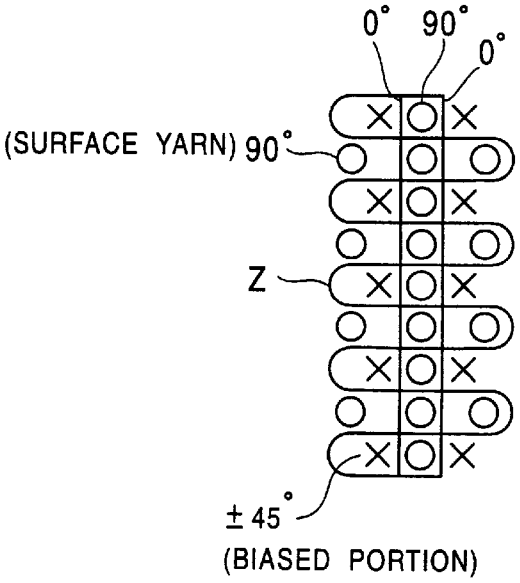
FIG. 31 is a sectional view of the three-dimensional 5-axis woven fabric taken along line XXXI—XXXI in FIG. 30.

In this three-dimensional weaving machine, the upper and lower vertical yarn insertion members 207 and 208 are used to insert the vertical yarns Z from both above and below the warps X and the biased yarns B1, B2, and the vertical yarns Z are used to connect the warps X, wefts Y and biased yarns B1, B2 together. Therefore, the vertical yarns Z continue in the longitudinal direction (the winding direction) in such a way that the vertical yarns Z from the upper vertical yarn insertion member 207 and those from the lower vertical yarn insertion member 208 are alternately arranged in the lateral direction, as shown in FIG. 30. In other words, when viewed at a certain position of the weft Y, the vertical yarn Z is alternately folded at the top and bottom of the woven fabric W to uniformize its thickness-wise strength.

The wefts Y, which constitute surface yarns, are inserted at those width-wise positions along and between rows of vertical yarns Z in the winding direction that do not correspond to the intersections of the biased yarns B1, B2. The vertical yarns Z are folded by being caught on the wefts Y, which are the surface yarns, whereas where there are no surface yarns, they are folded by being caught on the intersections of the biased yarns B1, B2.

As described above, according to this embodiment, the vertical yarns Z are inserted from both above and below the warps X and the biased yarns B1, B2, and are used to connect the warps X, wefts Y and biased yarns B1, B2. As a result, the warps X, wefts Y, and biased yarns B1, B2 can be connected reliably to uniformize the thickness-wise strength of the woven fabric W in order to achieve the intended object.

The three-dimensional weaving machine according to this embodiment includes a woven-form retention apparatus 307 located along the winding direction of the woven fabric W starting from the position of the cloth fell 206 in FIG. 20 and a press apparatus 308 located immediately after the position of the cloth fell 206.

Figure 32:
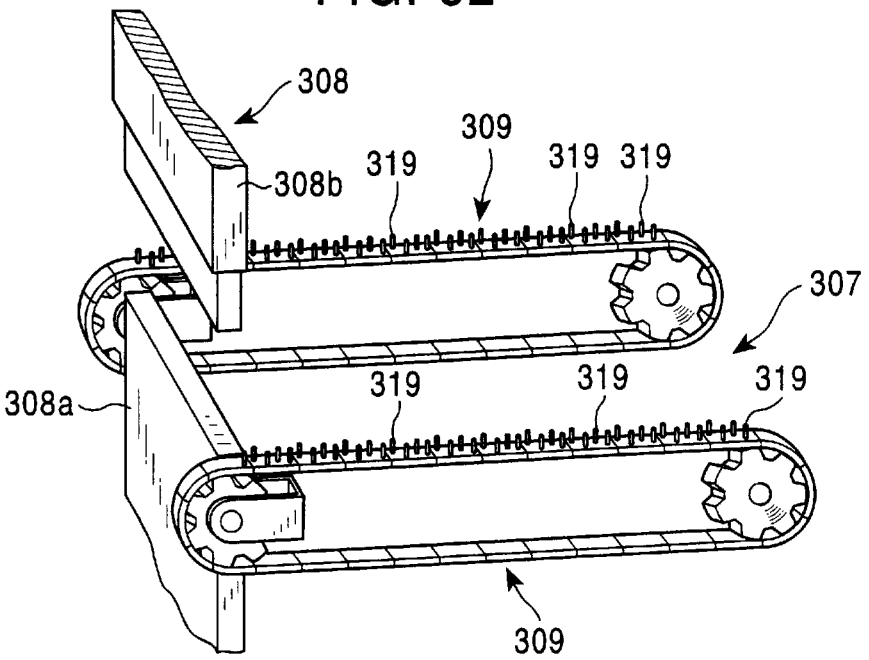
FIG. 32 is a perspective view of a woven-form retention apparatus and a press apparatus.

FIG. 32 is a perspective view of the woven-form retention apparatus 307 and the press apparatus 308. The woven fabric is omitted from FIG. 32.

As shown in FIG. 32, the woven-form retention apparatus 307 has a pair of chain conveyors 309, 309 located at an interval in the width direction of the woven fabric. The rear surface of the woven fabric, in particular, the rear surface of the selvedge portion of the woven fabric, is loaded on the transfer surface of each chain conveyor 309 so that the woven fabric is transferred in the winding direction. Furthermore, the woven-form retention apparatus 307 has a plurality of weft engaging pins 319 that protrudes from the transfer surface of each chain conveyor 309 and that are located at an equal interval in the woven fabric winding direction.

The press apparatus 308 includes, immediately after the position of the cloth fell, a fixed portion 308*a* located between the pair of chain conveyors 309, 309, and a movable portion 308*b* located above and opposite to the fixed portion 308*a*, and the fixed portion 308*a* and the movable portion 308*b* sandwich the woven fabric in the thickness direction. In this case, the top end surface of the fixed portion 308*a* is located below the transfer surface of the chain conveyor 309 so as not to contact the rear surface of the woven fabric being transferred.

In addition, both the fixed portion 308*a* and the movable portion 308*b* can be moved back and forth in the woven fabric winding direction by an appropriate guide and an appropriate drive mechanism while sandwiching the woven fabric.

Figure 33A:
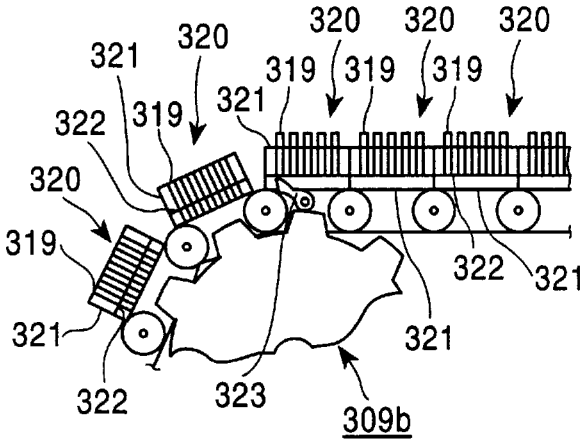
FIG. 33A is a side sectional view of the chain section.
Figure 33B:
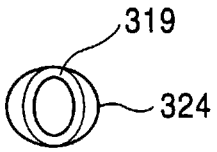
FIG. 33B is a top view showing a configuration of an opening in the top surface of the link section.

FIG. 33 shows the structure of a chain section of the chain conveyor 309. FIG. 33A is a side sectional view of the chain section, and FIG. 33B is a top view showing the configuration of an opening in the top surface of a link section.

As shown in FIG. 33A, each link section 320 of the chain section includes a casing 321 on its outer surface, and the top surface of the casing 321 forms the transfer surface of the chain conveyor 309. In the casing 321, the plurality of weft engaging pins 319 are supported by a support member 322 so as to extend in the vertical direction and are arranged at an equal interval in the moving direction of the chain section. In this case, each weft engaging pin 319 can be moved in its longitudinal direction relative to the support member 322.

As shown in FIG. 33B, the weft engaging pin 319 is formed of a cylindrical elastic member having an elliptical cross section, and circular openings 324 are opened in the top surface of the casing 321 at those positions that correspond to the weft engaging pins 319. In this case, the major axis of the elliptical cross section of the weft engaging pin 319 is slightly longer than the diameter of the circular opening 324. Consequently, when the weft engaging pin 319 protrudes outward from the circular opening 324, its outer circumferential surface engages the inner circumferential surface of the circular opening 324 to prevent it from slipping out and falling into the casing 321.

A pin hammer 323 that allows the weft engaging pin 319 to protrude out from the circular opening 324 in the top surface of the casing 321 is located near the position of the cloths fell. Each time each link section 320 of the chain section reaches the upper side of the loop of the chain section as the chain section is rotationally driven by a sprocket 309*b* of the chain conveyor 309, the pin hammer 323 allows the weft engaging pins 319 to sequentially protrude out from the top surface of the casing 321 near the position of the cloth fell. On the upper side of the loop of the chain section, the weft engaging pins 319 protrude out from the transfer surface of the chain conveyor 309 and are arranged at an equal interval in the woven fabric winding direction. The protruding weft engaging pins 319 are housed inside the casing 321 by an appropriate means (not shown in the drawings) when each link section 320 reaches the lower side of the loop of the chain section.

Figure 43:
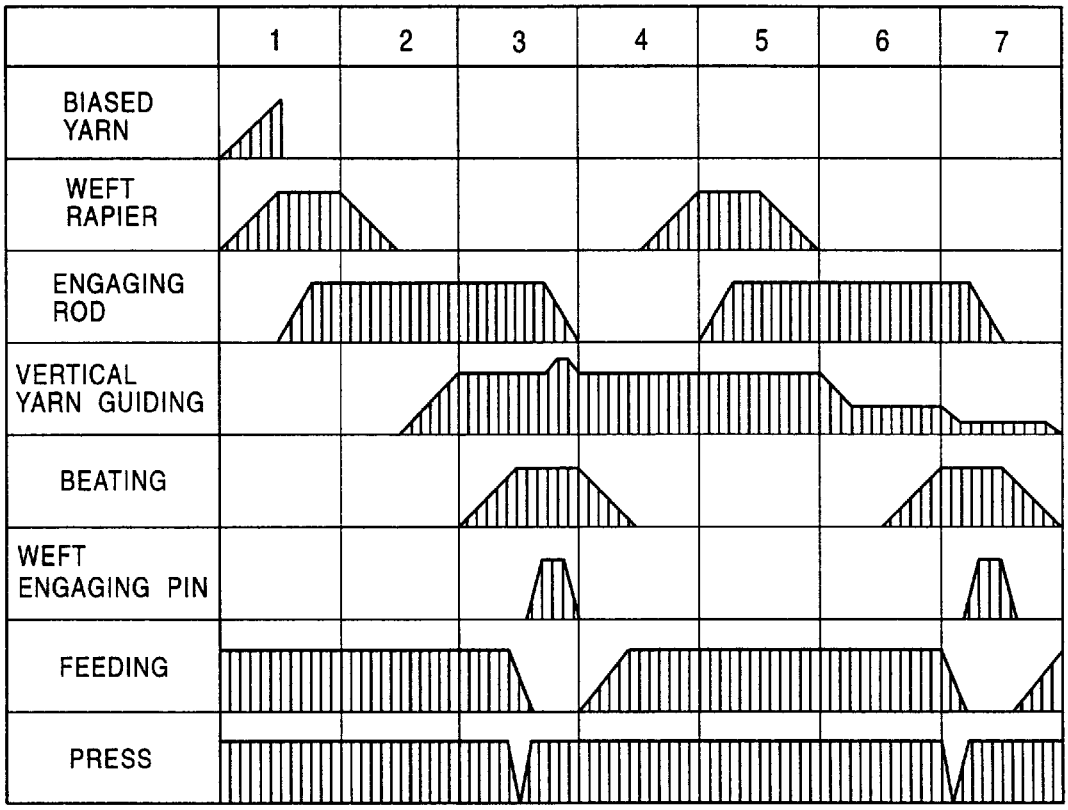
FIG. 43 is a diagram showing the operation of each member of the three-dimensional weaving machine wherein the vertical axis represents the position and the horizontal axis represents time.

FIG. 43 is a diagram showing the operation of each member of the three-dimensional weaving machine according to this embodiment. In FIG. 43, the vertical axis indicates the position, and the horizontal axis denotes time.

In the diagram in FIG. 43, the lower side of the "weft rapier" row 302 denotes an insertion port side while the upper side denotes the opposite side. The lower side of the "engaging rod" row indicates the lowered state of the engaging rods 326, 327 while the upper side indicates their protruding state. The vertical yarn guiding in this diagram indicates the vertical movement of vertical yarn insertion members 310*a*, 310*b*, and the lower side of this row denotes the state prior to insertion by the vertical yarn insertion members 310*a*, 310*b* while the upper side denotes the state after insertion. The small protrusion in the middle of this row indicates that during a beating operation, the vertical yarn insertion members 310*a* and 310*b* are lowered slightly (or raised) to tighten the woven fabric W.

In the diagram in FIG. 43, the "beating" indicates the horizontal movement of the vertical yarn insertion members 310*a*, 310*b*, and the lower side of this row denotes the state in which these members have moved to their rearmost positions while the upper side denotes the state in which they have moved forward to the position of the cloth fell. The lower side of the "weft engaging pin" row indicates the state in which the weft engaging pin 319 has been lowered, while the upper side indicates the state in which the pin protrudes from the woven fabric transfer surface. The "feeding" indicates the horizontal movement of the press apparatus 308, and the lower side of this row denotes the state in which the press apparatus 308 is located on the upstream side (close to the position of the cloth fell 206) while the upper side denotes the state in which the press is located on the downstream side (far from the position of the cloth fell 206). In other words, a feeding operation is performed when the diagram is tilted rightward and upward, whereas a returning operation is performed when the diagram is tilted rightward and downward. The chain conveyor 309 and the woven fabric winding apparatus 305 are moved one pitch in synchronism with the feeding of the press apparatus 308 for one pitch. In addition, the "press" in the diagram indicates the vertical movement of the movable portion 308*b* of the press apparatus 308, and the lower side of this row denotes the state in which the press apparatus 308 is opened, whereas the upper side denotes the state in which the press apparatus is closed.

FIGS. 34 to 38 are side views describing the vertical yarn insertion operation of the vertical yarn insertion members 310*a*, 310*b* and the operation of the press apparatus 308. For clarity, the lower vertical yarn insertion member 310*b* is omitted from these Figures.

Figure 34:
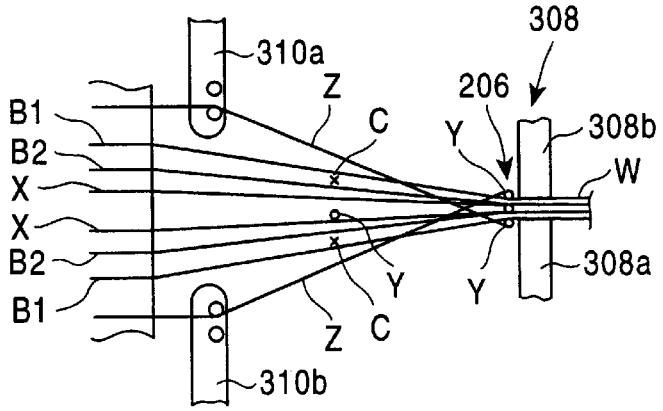
FIG. 34 is a side view describing a vertical yarn insertion operation performed by the vertical yarn insertion members and an operation of a press apparatus.

First, one weft Y is inserted between the layers of the warps X, i.e., between the layers of the biased yarns B1, B2, as shown in FIG. 34. In this case, the press apparatus 308 sandwiches the woven fabric W immediately after the position of the cloth fell 206. In the figure, C designates a point at which the biased yarns B1, B2 cross each other as seen from above.

Subsequently, the upper vertical yarn insertion member 310*a* lowers, while simultaneously the lower vertical yarn insertion member 310*b* is elevated.

Figure 35:
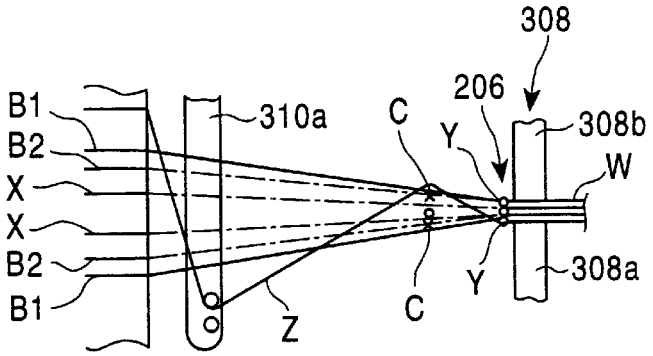
FIG. 35 is a side view describing a vertical yarn insertion operation performed by the vertical yarn insertion members and an operation of a press apparatus.

As shown in FIG. 35, the upper vertical yarn insertion member 310*a* is passed through the warps X and the biased yarns B1, B2 in their thickness direction, and the vertical yarn Z is inserted through the biased yarns B1, B2 and warps X from above. At the same time, the lower vertical yarn insertion member 310*b* is passed through the biased yarns B1, B2 and warps X, and the vertical yarn Z is inserted through the biased yarns B1, B2 and warps X from below. In this case, the press apparatus 308 also sandwiches the woven fabric W immediately after the position of the cloth fell 206.

Figure 36:
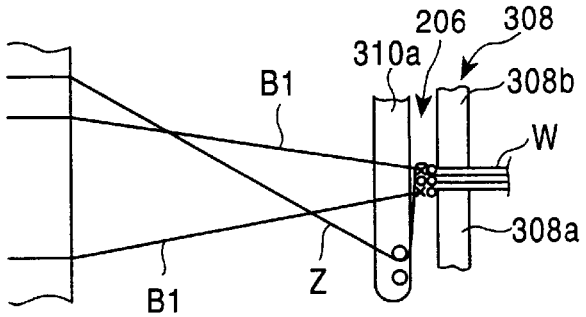
FIG. 36 is a side view describing a vertical yarn insertion operation performed by the vertical yarn insertion members and an operation of a press apparatus.

Subsequently, as shown in FIG. 36, the upper and lower vertical yarn insertion members 310*a* and 310*b* move forward to the position of the cloth fell 206 for a beating operation, while simultaneously the press apparatus 308 is opened. In response to this opening operation, the press apparatus 308 returns for one pitch (in this embodiment, 2 mm) in the direction opposite to the woven fabric W winding direction.

After the beating operation, the press apparatus 308 sandwiches the woven fabric W at the returned position. The upper vertical yarn insertion member 310*a* is lowered slightly, while the lower vertical yarn insertion Member 310*b* is elevated slightly. In this case, since the woven fabric W is sandwiched by the press apparatus 308, the vertical yarns Z are tightened. Subsequently, while sandwiching the woven fabric W, the press apparatus 308 is fed for one pitch in the woven fabric W winding direction to transfer the woven fabric W. In response to the transfer operation, the woven fabric W is wound around a woven fabric winding apparatus.

Figure 37:
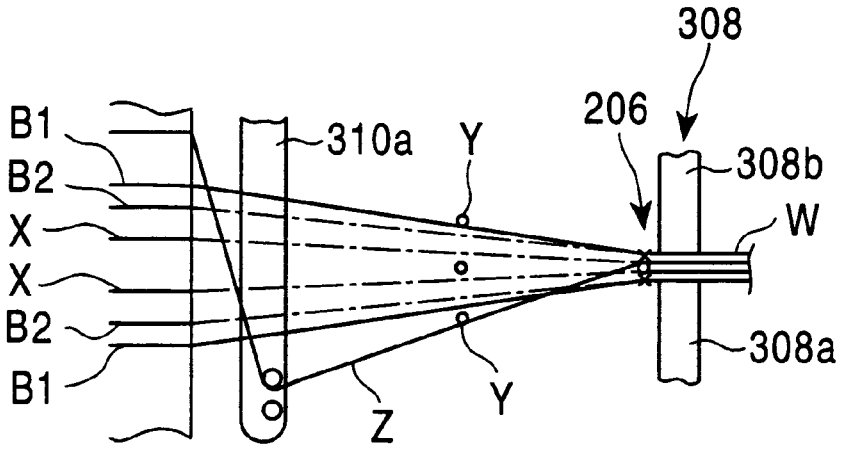
FIG. 37 is a side view describing a vertical yam insertion operation performed by the vertical yarn insertion members and an operation of a press apparatus.

Next, as shown in FIG. 37, the upper and lower vertical yarn insertion members 310*a* and 310*b* moves backward from the position of the cloth fell 206. One weft Y is inserted between the layers of the warps X, and the wefts Y are inserted outside the layers of the outer-most biased yarn B1. These three wefts Y are passed between the layers of the vertical yarns Z from the upper vertical yarn insertion member 310*a* and the layers of the vertical yarns Z from the lower vertical yarn insertion member 310*b*. In this case, the weft Y inserted outside the outermost biased yarn B1 to form a surface yarn. At this point, the press apparatus 308 sandwiches the woven fabric W at the fed position.

Figure 38:
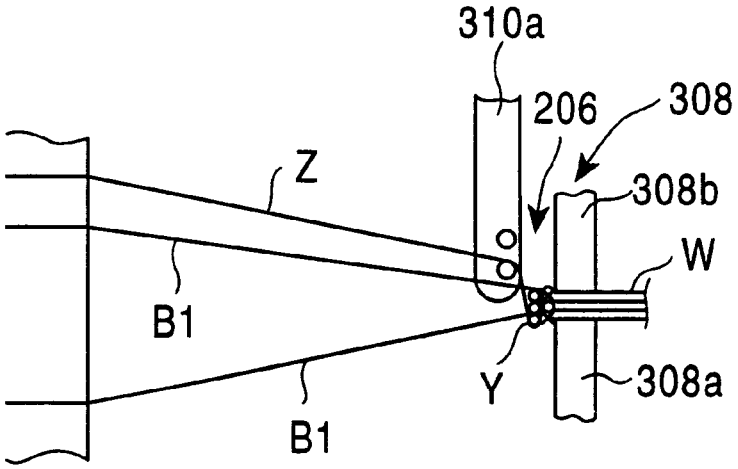
FIG. 38 is a side view describing a vertical yarn insertion operation performed by the vertical yarn insertion members and an operation of a press apparatus.

Subsequently, as shown in FIG. 38, the upper and lower vertical yarn insertion members 310*a* and 310*b* move forward to the position of the cloth fell 206 for a beating operation, while simultaneously the press apparatus 308 is opened. In response to this opening operation, the press apparatus 308 returns for one pitch in the direction opposite to the woven fabric W winding direction.

After the beating operation, the press apparatus 308 sandwiches the woven fabric W at the returned position. The upper vertical yarn insertion member 310*a* is lowered slightly, while the lower vertical yarn insertion member 310*b* is elevated slightly. In this case, since the woven fabric W is sandwiched by the press apparatus 308, the vertical yarns Z are tightened. Subsequently, while sandwiching the woven fabric W, the press apparatus 308 is fed for one pitch in the woven fabric W winding direction to transfer the woven fabric W. In response to the transfer operation, the woven fabric W is wound around a woven fabric winding apparatus.

Subsequently, the upper vertical yarn insertion member 310*a* elevates to its initial position (shown in FIG. 34), while the lower vertical yarn insertion member 310*b* lowers to its initial position. The weft Y is then inserted between the layers of the warps X, and the above series of operations are repeated.

In this manner, after the beating operation, the press apparatus 308 tightens the vertical yarns Z immediately after the position of the cloth fell while sandwiching the woven fabric W, so three-dimensional woven fabrics with a rigid and close organization can be obtained.

The three-dimensional weaving machine according to the present invention includes an engaging rod that moves in the horizontal and vertical directions in response to the weft Y insertion operation and the operation of the woven-form retention apparatus 307 in order to engage the weft Y with the weft engaging pin 319 at the front-most position relative to the position of the cloth fell 206.

FIGS. 39 to 42 are top views describing the weft Y insertion operation and the operation of the woven-form retention apparatus 307. For clarity, the press apparatus 308 and the vertical yarn insertion members 310*a* and 310*b* are omitted from these Figures.

In FIGS. 39 to 42, the weft Y is inserted by a weft rapier 325.

Figure 39:
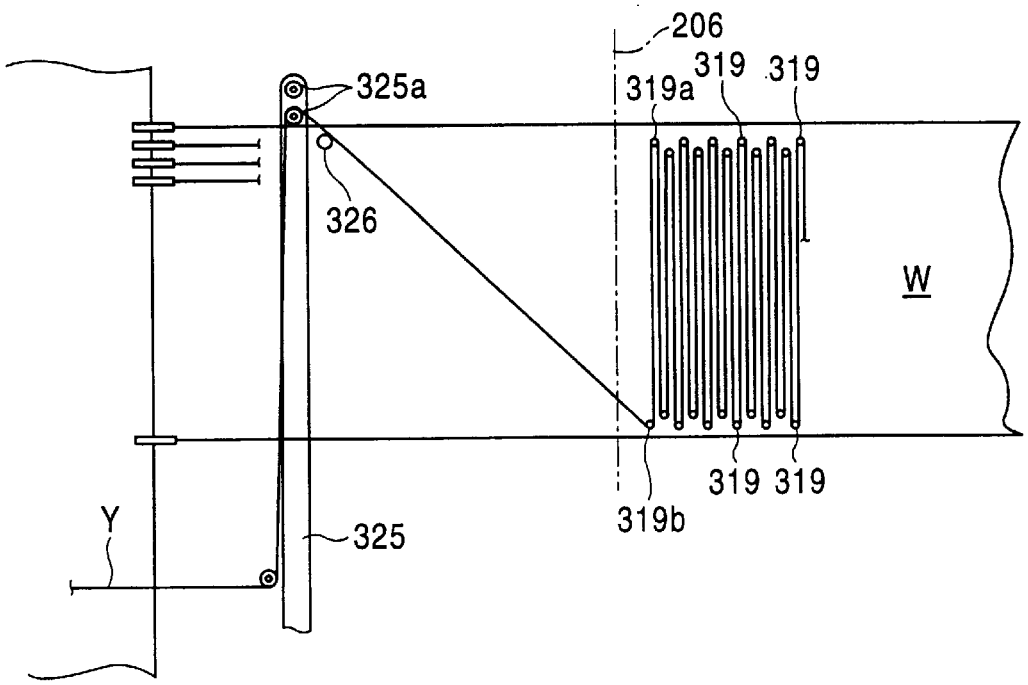
FIG. 39 is a top view showing an operation of engaging rod, a weft insertion peration, and an operation of the woven-form etention apparatus.

First, after the woven fabric W has been wound, the weft rapier 325 inserts the weft Y, as shown in FIG. 39. At this point, the weft Y from a pair of rollers 325*a* at the tip of the weft rapier 325 is caught on the weft engaging pin 319*b* located on the insertion port side of the weft rapier 325 and at the front-most position relative to the position of the cloth fell 206.

After the weft Y has been inserted, in the area between the weft rapier 325 and the weft Y from the weft rapier 325, the first engaging rod 326 protrudes upward from the plane on which the weft Y is located. The weft rapier 325 then moves backward to the insertion port, and the first engaging rod 326 moves to the exterior of the woven fabric W on the opposite side of the insertion port, thereby allowing the weft Y to be caught on the first engaging rod 326.

Figure 40:
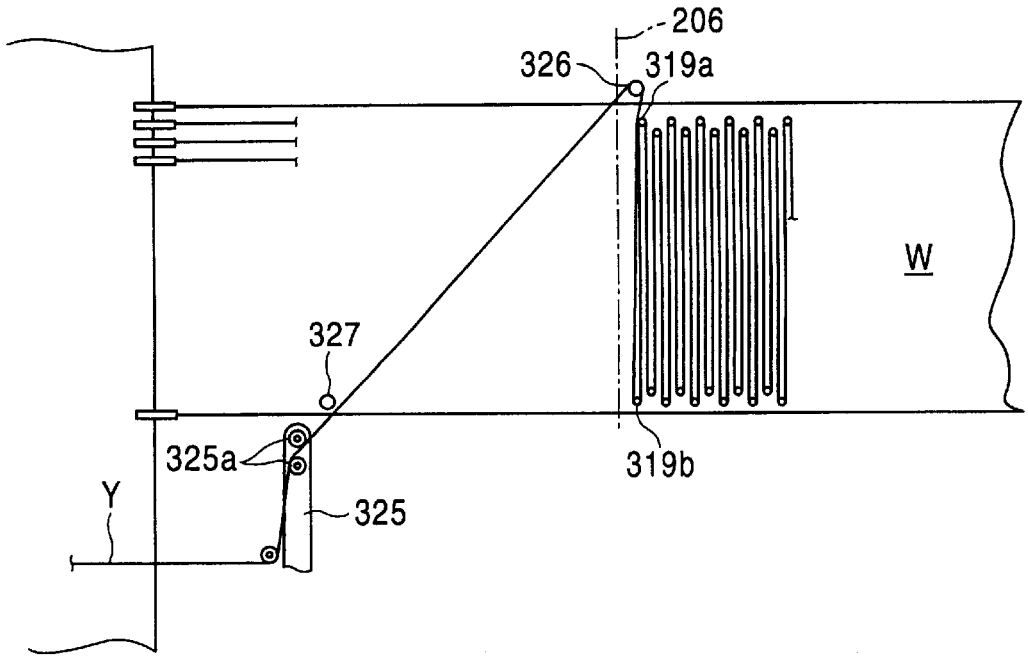
FIG. 40 is a top view showing an operation of engaging rod, a weft insertion operation, and an operation of the woven-form retention apparatus.

Subsequently, as shown in FIG. 40, the first engaging rod 326, on which the weft Y is caught, moves beyond the position of the cloth fell 206 along the woven fabric W winding direction, outside the woven fabric W in parallel therewith. It then stops at a position nearly adjacent to the weft engaging pin 319*a* relative to the position of the cloth fell 206. Therefore, the weft Y leading toward the woven fabric W from the first engaging rod 326 abuts the weft engaging pin 319*a*.

On the other hand, in an area near the insertion port of the weft rapier 325 and adjacent to the weft Y leading from the weft rapier 325 to the first engaging rod 326, the second engaging rod 327 protrudes upward from the plane in which the weft Y is located.

At the same time, the next weft engaging pin 319*c* protrudes upward from the transfer surface on the side of the first engaging rod 326 and near the position of the cloth fell 206. In this case, the weft engaging pin 319*c* protrudes between the weft Y leading from the first engaging rod 326 toward the weft rapier 325 and the weft leading toward the woven fabric W. According to this embodiment, the interval between the weft engaging pin 319 located adjacent in the woven fabric W winding direction is set at 2 mm.

Figure 41:
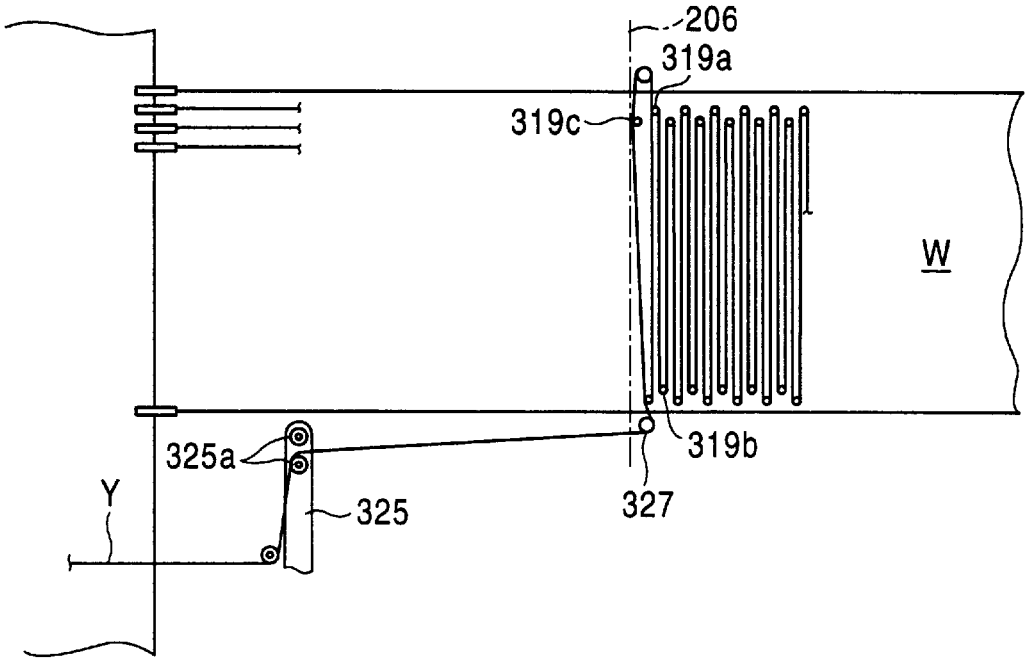
FIG. 41 is a top view showing an operation of an engaging rod, a weft insertion operation, and an operation of the woven-form retention apparatus.

On the insertion port side of the weft rapier 325, the second engaging rod 327 moves to the exterior of the woven fabric W. Then, as shown in FIG. 41, the second engaging rod 327, on which the weft Y is caught, moves beyond the position of the cloth fell 206 along the woven fabric W winding direction, outside the woven fabric W in parallel therewith. It then stops at a position nearly adjacent to the weft engaging pin 319*b* located on the front-most position relative to the position of the cloth fell 206. Therefore, the weft Y leading toward the woven fabric W from the second engaging rod 327 abuts the weft engaging pin 319*b*. At the same time with the movement of the second engaging rod 327, the vertical yarn insertion member 310*a*, 310*b* described above performs a beating operation.

Figure 42:
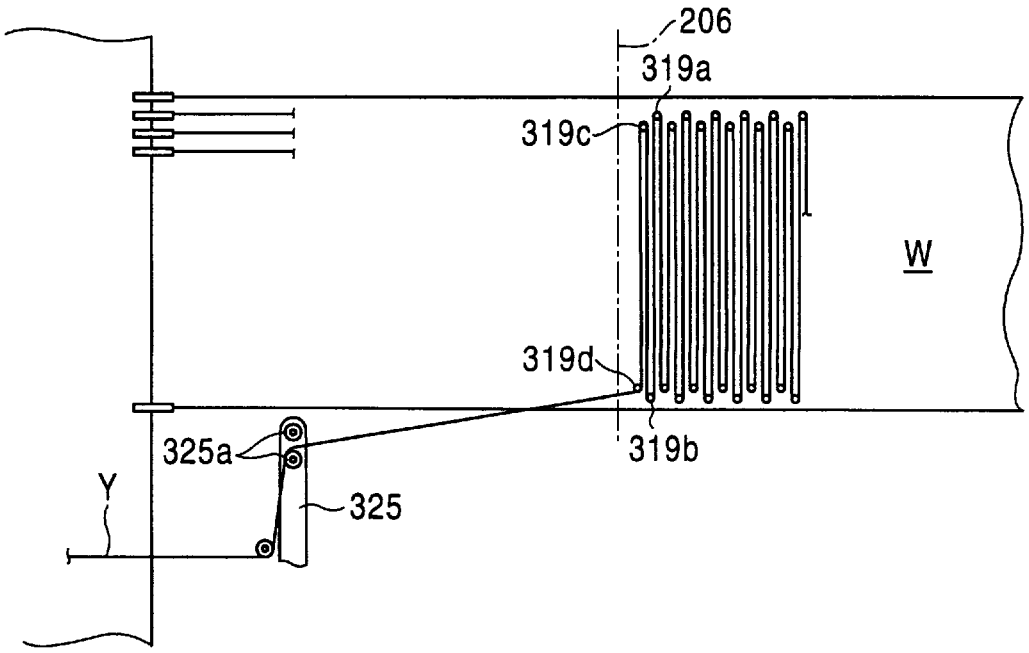
FIG. 42 is a top view showing an operation of an engaging rod, a weft insertion operation, and an operation of the woven-form retention apparatus.

The next weft engaging pin 319*d* then protrudes upward from the transfer surface on the side of the second engaging rod 327 and near the position of the cloth fell 206. Subsequently, as shown in FIG. 42, the first and second engaging rods 326 and 327 move downward from the transfer surface to its initial position, and the weft Y is caught on the weft engaging pins 319*c* and 319*d*.

Subsequently, the woven fabric W is wound by being transferred one pitch (2 mm), and the weft rapier 325 again inserts the weft Y. Then, the above series of operations are repeated.

In this manner, the weft Y is engaged with the weft engaging pins 319 arranged at both the selvedge of the woven fabric W at an equal interval in the longitudinal direction. Therefore, when the press apparatus 308 is used to tighten the vertical yarns Z, a constant woven form can be maintained without causing the woven fabric W to contract in the width or longitudinal direction.

As described above, this embodiment can provide a high-quality three dimensional woven fabric with a rigid and close fabric. This three-dimensional woven fabric can be used as a base to provide a sufficiently strong composite material by being impregnated with a resin and then hardened.

Conventional three-dimensional weaving machines use a biased yarn orientation apparatus with an annular track to transfer each biased yarn along the annular track. This configuration enables each biased yarn to be oriented and operated, and in a set of two biased yarn layers, the biased yarns in one of the layers are tilted at an angle of +45° relative to the warps, whereas the biased yarns in the other layer are tilted at an angle of −45° relative to the warps. This configuration, however, requires a large number of bobbins to be used for a yarn supply apparatus for supplying biased yarns and to be moved along the annular track in response to the biased yarn orientation apparatus. Therefore, this configuration is complicated and requires the size of the entire apparatus to be increased. Another problem is that only a small amount of yarn can be wound around bobbins, thereby preventing long biased yarns from being continuously supplied.

It is an object of this embodiment to provide a three-dimensional weaving machine that enables a yarn supply apparatus for supplying biased yarns to be miniaturized and to continuously supply long biased yarns.

This embodiment provides a yarn supply apparatus of a three-dimensional weaving machine, consisting of beams around which biased yarns are wound, a motor that rotates the beams to feed biased yarns, and a control means for controlling the rotation of the motor to adjust the amount of fed biased yarns.

According to a preferred embodiment, the apparatus includes a movable tension roller with which biased yarns to be fed are engaged and a position detection means for detecting the position of the tension roller. The control means adjusts the amount of fed biased yarns based on a detection signal from the position detection means.

According to a preferred embodiment, the position detection means includes a pair of position detection means located at an interval in the moving direction of the tension roller. The control means controls the rotation of the motor in such a way that the motor starts feeding biased yarns when one of the position detectors is turned on, and stops feeding biased yarns when the other position detector is turned on.

According to a preferred embodiment, a plurality of biased yarns are wound around a single beam, and on independently moving tension roller is provided for each biased yarn. The position detection means commonly detects the positions of the tension rollers, and the control means has a yarn-cut detection means for detecting a yarn cut based on a detection signal from the position detection means.

This embodiment is described in detail.

Figure 44:
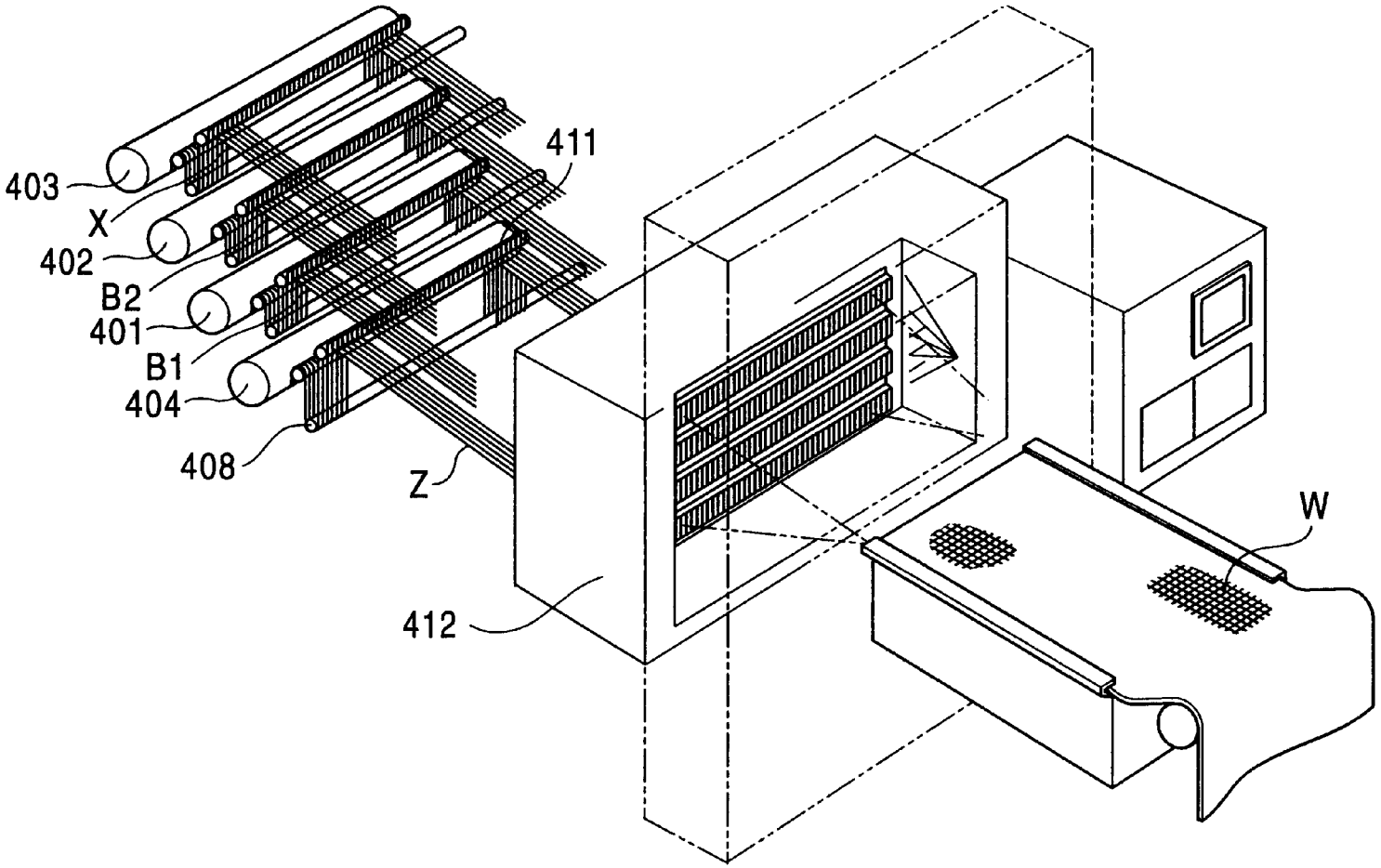
FIG. 44 is a perspective view of the three-dimensional weaving machine.
Figure 45:
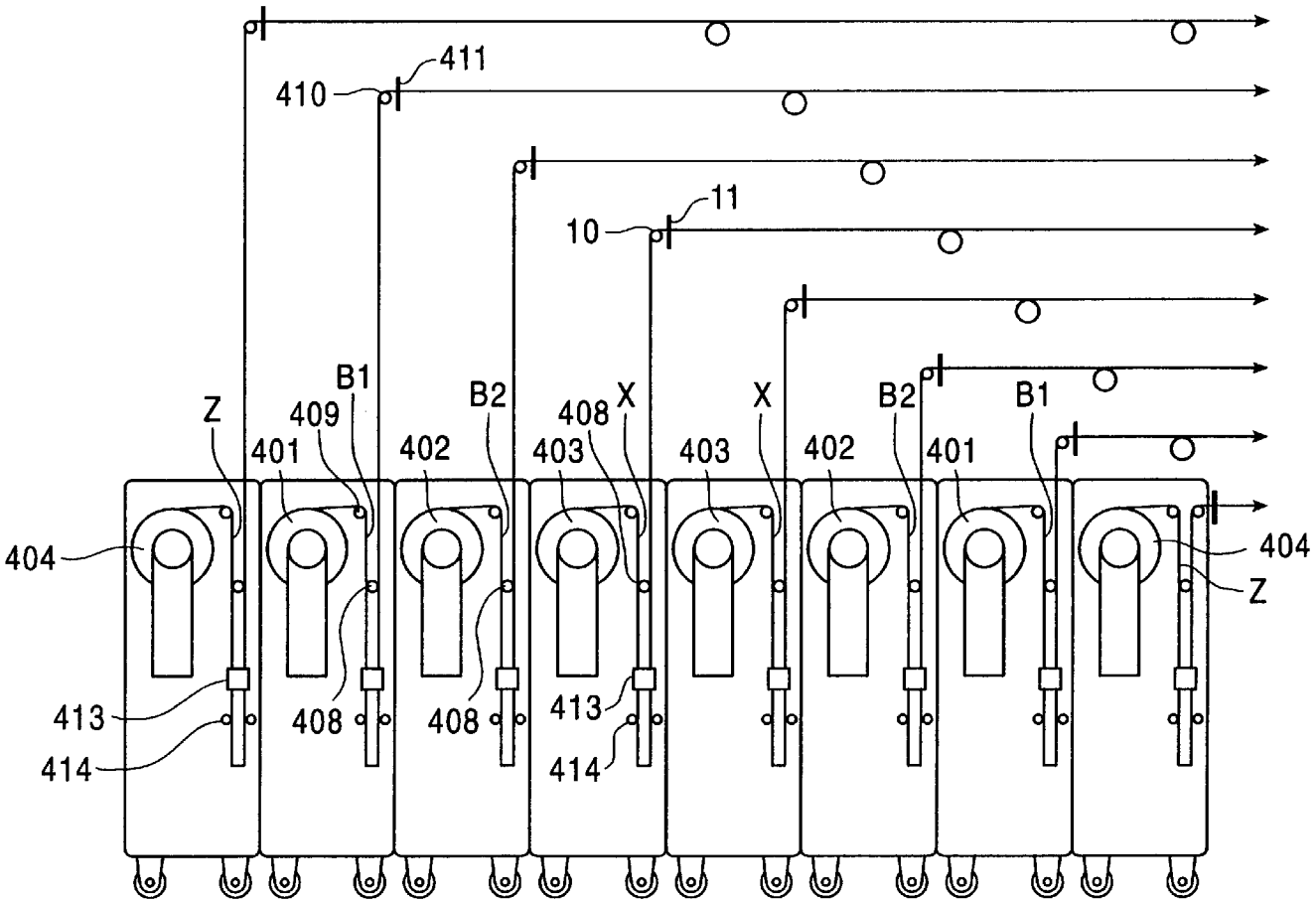
FIG. 45 is a side view of a yarn supply apparatus in FIG. 44.

FIG. 44 shows a three-dimensional weaving machine that produces three-dimensional 5-axis woven fabrics W and that has a plurality of beams 401 and 402. The biased yarn B1 is wound around the beam 401, and the biased yarn B2 is wound around the beam 402. According to this embodiment, a plurality of biased yarns B1 are wound around the beam 401, a plurality of biased yarns B2 are wound around the beam 402, and two pairs of the beams 401 and 402 are combined with other beams 403 and 404, as shown in FIG. 45. A plurality of warps X are wound around the beam 403, and the two beams 403 are located between the beams 401 and 402. A plurality of vertical yarns Z are wound around the beam 404, and the two beams 404 are located outside of the beams 401 and 402.

Figure 46:
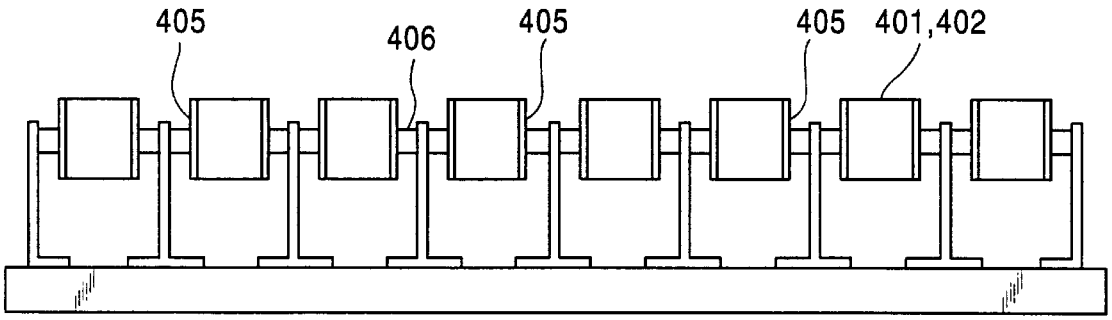
FIG. 46 is a front view of a beam in FIG. 45.
Figure 48:
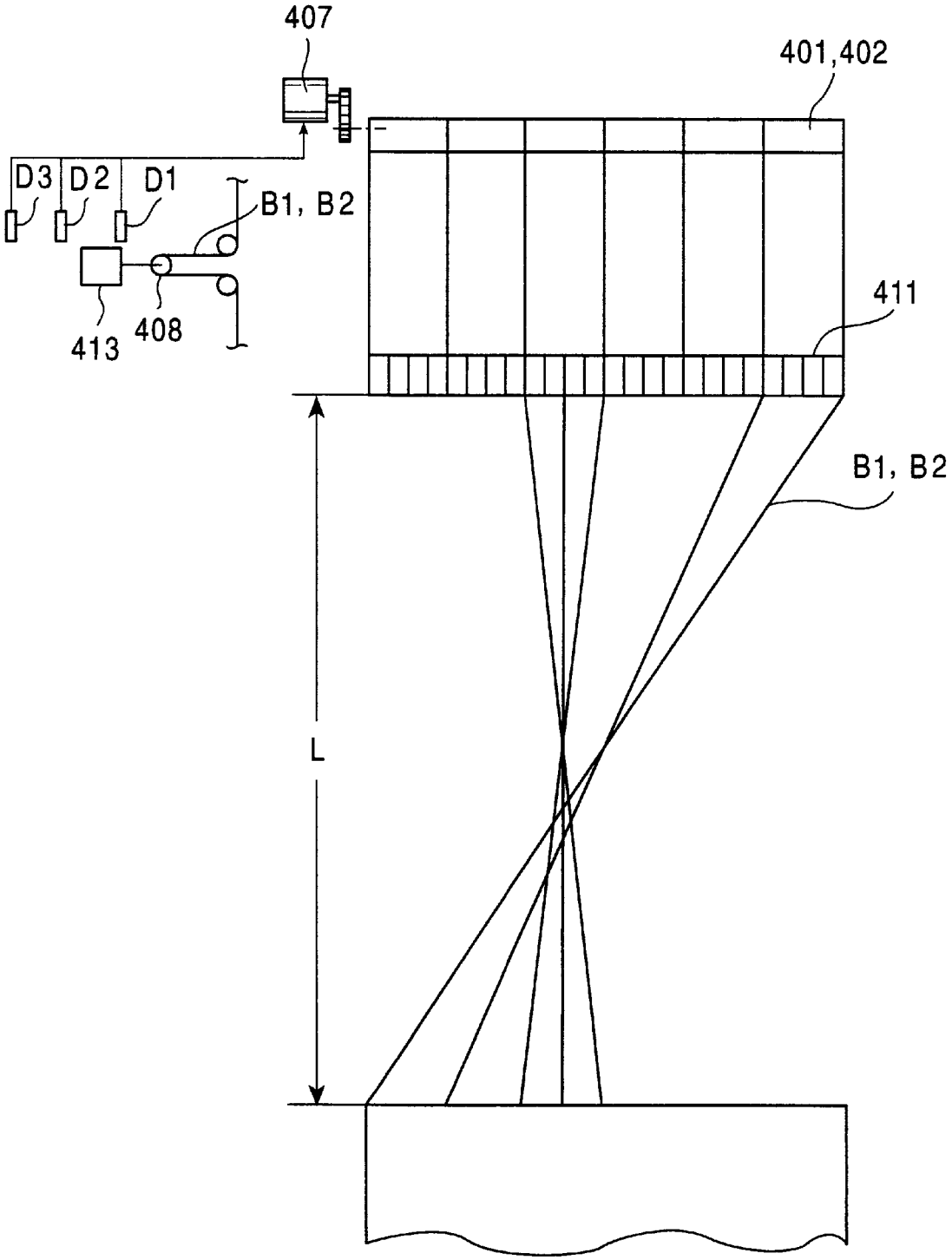
FIG. 48 is an explanatory drawing of the beam in FIG. 44.
Figure 49:
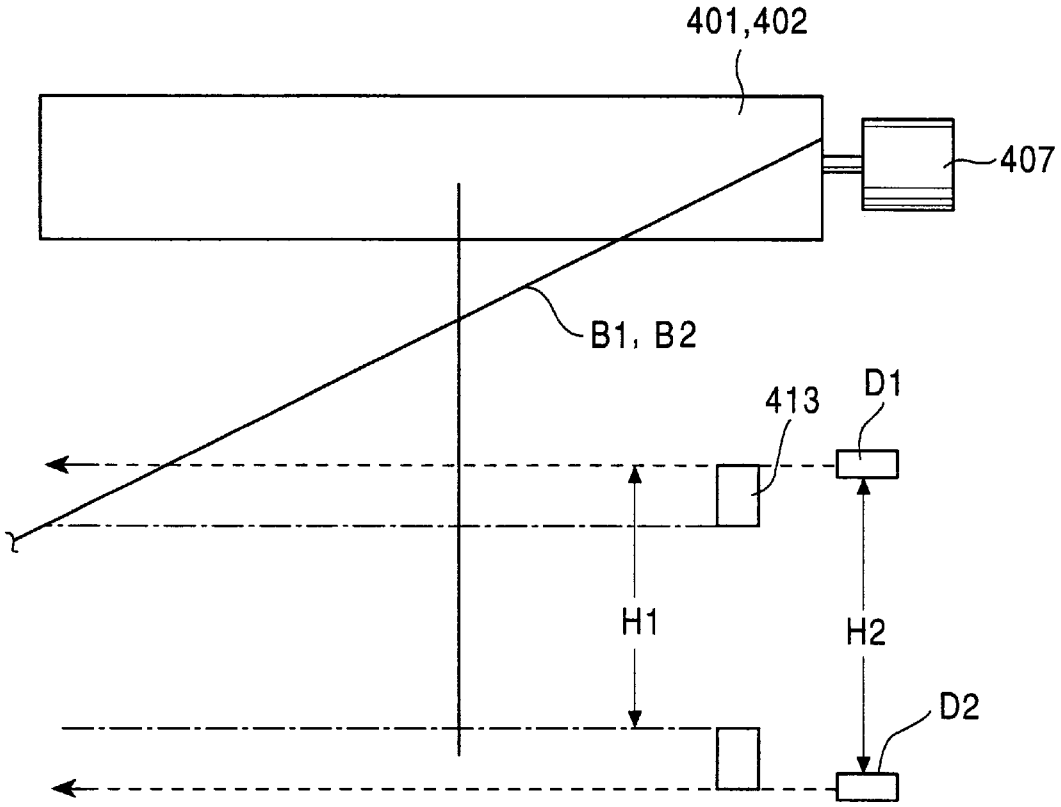
FIG. 49 is an explanatory drawing of a position detector in FIG. 48.

As shown in FIG. 46, the beams 401 and 402 form the biased yarns B1 and B2 have a large number of flanges 405 disposed at an interval and fixed to a common rotating shaft 406, and the biased yarns B1, B2 are wound between the flanges 405. Furthermore, as shown in FIG. 48, the motor 407 is coupled to the rotating shaft 406 to rotationally drive the beams 401, 402 in order to feed the biased yarns B1, B2. This is also applicable to the beams 403, 404 for the warps X and the vertical yarns Z.

Furthermore, at the beams 401, 402 for the biased yarns B1, B2, a tension roller 408 that can move in the vertical direction is provided for each of the biased yarns B1, B2. The biased yarns B1, B2 are fed from the beams 401, 402, pass around a guide roller 409, and engage the tension roller 408. The biased yarns B1, B2 further pass around a guide roller 410 and a split guide plate 411 and are guided to a frame 412 in which a biased yarn orientation apparatus 416 described below is provided. In this manner, the biased yarns B1, B2 engage the tension roller 408 between the guide rollers 409, 410 in such a way that the tension roller 408 bends the biased yarns B1, B2.

Figure 47:
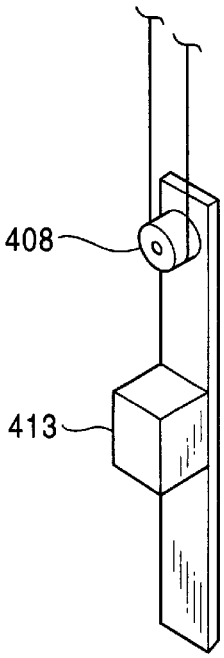
FIG. 47 is a perspective view of a tension roller and a weight in FIG. 45.

Furthermore, as shown in FIG. 47, a weight 413 is provided for each tension roller 408 and is connected thereto. The weight 413 can be guided by a guide member 414 so as to move with the tension roller 408 in the vertical direction.

Consequently, the weight 413 acts on the tension roller 408 and the biased yarns B1, B2, thereby applying to the biased yarns B1, B2 an approximately constant tension corresponding to the weight 413.

Furthermore, in each beam 401 or 402, a pair of position detectors D1 and D2 are disposed at an interval in the moving direction (the vertical direction) of the tension roller 408 to detect the position of the weight 413. According to this embodiment, the position detector D1 is disposed above the weight 413 in its normal position, while the position detector D2 is disposed below the weight 413 in its normal position. In each beam 401 or 402, the position detectors D1 and D2 each have an optical axis parallel with the rotating shafts of the beams 401, 402, and are common to each tension roller 408. Therefore, the position detector D1 detects when the weight 413 of the tension roller 408 for the beam 401 or 402 reaches the position of the position detector D1, while the position detector D2 detects when the weight 413 for the beam 401 or 402 reaches the position of the position detector D2. In this manner, the position of the tension roller 408 is indirectly detected by detecting the position of the weight 413. Moreover, a control means is connected to the position detectors D1, D2, and based on detection signals from the position detectors D1, D2, the rotation of the motor is controlled to adjust the amount of the fed biased yarns B1, B2, as descried below.

Furthermore, according to this embodiment, a position detector D3 is disposed below the position detector D2. The position detector D3 detects a yarn cut in the biased yarns B1, B2 and is common to each tension roller 408.

This is also applicable to the beams 403, 404 for the warps X and the vertical yarns Z. In the beams 403, 404 for the warps X and the vertical yarns Z, the motor drives and rotates the beams 403, 404 to feed the warps X and the vertical yarns Z from the beams 403, 404. The yarns pass around the tension roller 408 and are guided to the frame 412 to cause the weight 413 to act on the tension roller 408, thereby applying an approximately constant tension to the warps X and the vertical yarns Z. In each beam 403 or 404, the position of the weight 413 is detected by the position detectors D1, D2 common to each tension roller 408, and based on detection signals from these detectors, the control means controls the motor to adjust the amount of the fed warps X and vertical yarns Z. The position detector D3 common to each tension roller 408 also detects a yarn cut in the warps X and the vertical yarns Z, as described above.

Therefore, in this three-dimensional 5-axis weaving machine, when the biased yarns B1, B2 are supplied to the frame 412 in order to produce the woven fabric W, then in each beam 401 or 402, the biased yarns B1, B2 lift the tension roller 408 and the weight 413. The position detector D1 then detects when the weight 413 for either tension roller 408 for the beam 401 or 402 has reached the position of the position detector D1, and based on the detection signal from the position detector D1, the control means controls the motor 407 to drive and rotate the beams 401, 402 in order to feed the biased yarns B1, B2 from the beams 401, 402. This causes the tension roller 408 and the weight 413 to be lowered. The position detector D2 then detects when the weight 413 for either tension roller 408 has reached the position of the position detector D2, and based on the detection signal from the position detector, the control means controls the motor 407 to stop the motor 407 and the beam 401, 402 and thus the feeding of the biased yarns B1, B2. These operations are sequentially repeated and alternated to move the weight 413 between the position detectors D1, D2 while moving the tension roller 408 within a range corresponding to the distance between the piston detectors D1, D2.

In this three-dimensional weaving machine, when either biased yarn B1 or B2 on the beam 401 or 402 is cut, the position detector D3 detects when the weight 413 for the corresponding tension roller 408 passes the position of the position detector D3 and falls. This operation allows the yarn cut to be detected, and enables the present invention to deal with yarn cuts appropriately.

By allowing the position detector D3 located slightly below the position detector D2 to detect the weight 413, the yarn cut can be immediately detected when the position detector D3 is turned on. This, however, is not necessarily required. Instead of the position detector D3, a stopper used to prevent falling can be provided slightly below the position detector D2 so that a yarn cut can be determined when the position detectors D1, D2 are simultaneously turned on. In this case, although no yarn cut can be detected until D1 is turned on after D2 has been turned on, the number of required position detectors can be advantageously reduced.

This is also applicable to the beams 403, 404 for the warps X and the vertical yarns Z. The position detector D1 detects when the weight 413 for either tension roller 408 for the beam 403 or 404 has reached the position of the position detector D1, and the motor 407 drives and rotates the beams 403, 404 to feed the warps X and the vertical yarns Z from the beams 403, 404. The position detector D2 detects when the weight 413 for either tension roller 408 has reached the position of the-position detector D2, the motor 407 and the beams 403, 404 stop to halt the feeding of the warps X and the vertical yarns Z. Accordingly, the weight 413 moves between the position detectors D1, D2 and the tension roller 408 moves within a range corresponding to the distance between the position detectors D1 and D2. The position detectors D3 or D1 and D2 detect a yarn cut in the warps X and the vertical yarns Z, as described above.

This three-dimensional weaving machine uses the biased yarn orientation apparatus (shown at 6 in FIGS. 1 and 2) using a snake-motion instead of an annular track, which allows the biased yarns B1, B2 to perform a sequential snake motion for orientation. This configuration eliminates the needs to use a large number of bobbins for the yarn supply apparatus for supplying the biased yarns B1, B2 and to move each bobbin along the annular track, and allows the beams 401, 402 to be used for the yarn supply apparatus.

Figure 50:
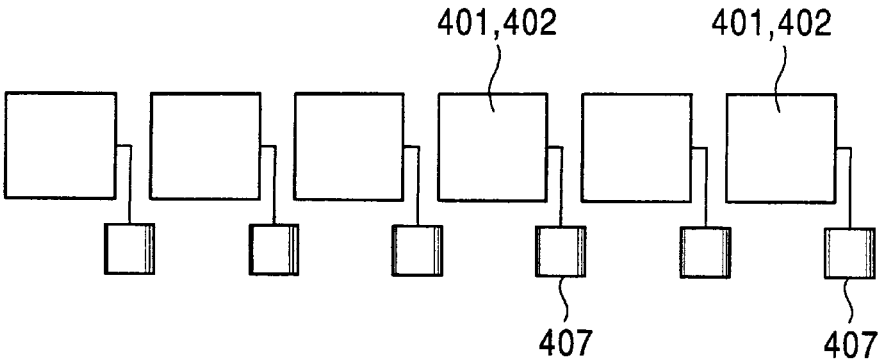
FIG. 50 is an explanatory drawing of another embodiment of the yarn supply apparatus in FIG. 44.

Moreover, since the biased yarns B1, B2 are orientated by the biased yarn orientation apparatus, the lengths of the biased yarns B1, B2 between the split guide plate 411 and the biased yarn orientation apparatus vary with their inclinations despite the approximately constant lengths of the biased yarns B1, B2. Thus, during weaving, the weights 413 for the beams 401, 402 are located at different heights dending on the inclinations of the biased yarns B1, B2, and so the distance H2 between the position detectors D1 and D2 is set to be larger than this difference H1 in height. This configuration prevents both position detectors D1 and D2 from being turned on simultaneously due to the difference in the height of the weights 413 caused by the orientation of the biased yarns B1, B2. This difference in height increases with increasing length of the beams 401, 402, and as shown in FIG. 50, the distance between the position detectors D1 and D2 can be set at a smaller value by dividing each beam 401 or 402 into a plurality of beams and providing a motor 407 for each of the beams.

This three-dimensional weaving machine enables a large number of biased yarns B1 or B2 to be wound around the single beam 401 of 402 and to be supplied therefrom, thereby miniaturizing the yarn supply apparatus for supplying the biased yarns B1, B2. Long biased yarns B1, B2 can also be wound around the beams 401, 402 for continuous supply.

As described above, this embodiment allows each biased yarn to be supplied from the beam, thereby enabling the biased yarn orientation apparatus to be miniaturized and long biased yarns to be continuously supplied.

This embodiment enables the biased yarns to be fed under an approximately constant tension without being loosened by adjusting the amount of fed biased yarns depending on the position of the tension roller.

This embodiment enables the amount of fed biased yarns to be adjusted using the simple control.

This embodiment enables yarn cuts to be reliably detected using the simple configuration.

What is claimed is:

1. A three-dimensional weaving machine comprising a biased yarn orientation apparatus for feeding yarns in a diagonal direction relative to a layer of warps, a weft insertion apparatus for feeding wefts, a vertical yarn insertion apparatus for inserting yarns in the vertical direction relative to said layer of the warps, a layer of biased yarns and a layer of wefts, said biased yarn orientation apparatus comprising:

2N movable guide blocks each having a biased yarn insertion hole;

a guide block receiving and supporting means that forms guide block arrangement spaces in a top stage, a middle stage and a bottom stage, wherein N guide blocks can be arranged parallel and adjacent to one another as a set in each stage;

a guide block moving means for moving adjacent guide blocks along the respective stages in opposite directions; and a shifting means for simultaneously shifting the guide blocks arranged in the guide block arrangement spaces in two adjacent stages in such a way that each set of guide blocks is shifted by one stage.

2. A three-dimensional weaving machine according to claim 1 in which said guide block moving means comprises a transverse moving means for pressing the guide blocks in each stage sideways to feed them in a transverse direction; and a raising means for raising a guide block that protrudes sideward from a space; and in which said shifting means comprises a lowering means for simultaneously shifting the set of guide blocks arranged in said middle and top stages in such a way that each set is shifted downwardly by one stage.

3. A three-dimensional weaving machine according to claim 2 in which said guide block moving means comprises a transverse moving means for pressing the guide blocks in each stage sideways to feed them in the transverse direction; and a lowering means for lowering a guide block that protrudes sideward from a space; and in which said shifting means comprises a lifting means for shifting together the sets of guide blocks arranged in said middle and bottom stages in such way that each set is shifted upwardly by one stage.

4. A three-dimensional weaving machine according to any one of claims 1 to 3 in which said shifting means includes a sandwiching means for sandwiching two sets of guide blocks together in the vertical direction and shifting each set by one stage.

5. A biased yarn feeding apparatus for a three-dimensional weaving machine comprising a biased yarn orientation apparatus for feeding yarns in a diagonal direction relative to a layer of warps;

a weft insertion apparatus for feeding wefts; and a vertical yarn insertion apparatus for inserting yarns in the vertical direction relative to said layer of warps;

a layer of biased yarns and a layer of wefts, said biased yarn orientation apparatus includes 2N movable guide blocks each having a small diameter portion;

a guide block receiving and supporting means that forms guide block arrangement spaces in a top stage and a bottom stage wherein N guide blocks can be arranged parallel and adjacent to one another as a set in each stage;

a vacant area forming means movable between the small diameter portions of adjacent guide blocks in sets disposed in either of the stages to move the adjacent guide blocks a distance of one block in the transverse direction in order to form one block of vacant area so that a guide block in the other stage can advance into said vacant area;

a shifting means for shifting a guide block that protrudes sidewardly from the space; and a pressing means for pressing the shifted guide blocks sideways in such a way as to move them a distance of one block in a transverse direction.

6. A biased yarn feeding apparatus for a three-dimensional weaving machine according to claim 5 in which said vacant area forming means comprises a pair of movable claw members; and means for alternately driving said claw members to advance in between the small diameter portions of adjacent guide blocks and in a lateral direction to move the guide blocks a distance of one block.

7. A biased yarn feeding apparatus for a three-dimensional weaving machine comprising 2N movable guide blocks having a plurality of threading pipes connecting guide blocks together in such a way as to form a chain and each including a catching groove;

a guide block receiving and supporting means that forms guide block arrangement spaces in a bottom stage and a top stage wherein N guide blocks are arranged in each stage in parallel and adjacent to one another; and a vacant area forming means that engages the catching groove in said guide block to alternatively move said guide blocks in each stage a distance of one block in a transverse direction in order to form a distance of one block of vacant area so that a guide block in the other stage can advance into said vacant area.

8. A three-dimensional weaving machine comprising a biased yarn orientation apparatus for feeding yarns in a diagonal direction relative to a layer of warps, a weft insertion apparatus for feeding wefts, and a vertical yarn insertion apparatus for inserting yarns in the vertical direction relative to said layer of warps, a layer of biased yarns and a layer of wefts, said vertical yarn insertion means comprising:

an upper vertical yarn insertion member for inserting vertical yarns from above said warps and biased yarns that are guided to a cloth fell;

a lower vertical yarn insertion member for inserting vertical yarns from below said warps and biased yarns;

means for moving said upper and lower vertical yarn insertion members toward said cloth fell;

a press positioned adjacent said cloth fell and operative to compress woven fabric following insertion of said vertical yarns; and means for extending the lowering of said upper vertical yarn insertion member and the raising of said lower vertical yarn insertion member substantially simultaneously with operation of said press for tightening said vertical yarns.

9. A three-dimensional weaving machine comprising a biased yarn orientation apparatus for feeding yarns in a diagonal direction relative to a layer of warps, a weft insertion apparatus for feeding wefts, and a vertical yarn insertion apparatus for inserting yarns in a vertical direction relative to said layer of warps, a layer of biased yarns and a layer of wefts, said vertical yarn insertion means including an upper vertical yarn insertion member for inserting vertical yarns from above said warp and biased yarns that are guided to a cloth fell; and a lower vertical yarn insertion member for inserting vertical yarns from below said warp and biased yarns, and means for moving said upper and lower vertical yarn insertion members toward said cloth fell to allow said upper and lower vertical yarn insertion members to perform a beating motion.

10. A three-dimensional weaving machine according to claim 9 characterized in that a plurality of upper vertical yarn insertion members and a plurality of lower vertical yarn insertion members are alternately arranged along the width direction of a woven fabric.

* * * * *